US007512347B2

(12) United States Patent
Suzuki et al.

(10) Patent No.: US 7,512,347 B2
(45) Date of Patent: Mar. 31, 2009

(54) IMAGE-FORMING DEVICE CAPABLE OF DETERMINING INFORMATION ON A DETACHABLY MOUNTED DEVELOPER CARTRIDGE AND DEVELOPER CARTRIDGE FOR USE THEREIN

(75) Inventors: Tsutomu Suzuki, Nagoya (JP); Takeyuki Takagi, Nagoya (JP); Yoshifumi Kajikawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 67 days.

(21) Appl. No.: 11/362,820

(22) Filed: Feb. 28, 2006

(65) Prior Publication Data

US 2006/0193646 A1 Aug. 31, 2006

(30) Foreign Application Priority Data

Feb. 28, 2005 (JP) ..... 2005-055104
Jun. 21, 2005 (JP) ..... 2005-180962

(51) Int. Cl.
*G03G 15/00* (2006.01)
*G03G 15/08* (2006.01)

(52) U.S. Cl. ..... 399/12; 399/27; 399/119

(58) Field of Classification Search ..... 399/12, 399/27, 119, 120, 110, 111, 90
See application file for complete search history.

(56) References Cited

U.S. PATENT DOCUMENTS 4,500,195 A 2/1985 Hosono
4,974,020 A 11/1990 Takamatsu et al.
4,977,428 A 12/1990 Sakakura et al.
5,768,659 A 6/1998 Kameda
6,154,619 A 11/2000 Boockholdt et al.
6,256,469 B1 7/2001 Taniyama et al.
6,330,402 B1 12/2001 Sakurai et al.
6,343,883 B1 2/2002 Tada et al.
2001/0005460 A1 6/2001 Shiratori et al.
2001/0036368 A1 * 11/2001 Curry et al. ..... 399/12
2003/0137578 A1 7/2003 Yamazaki
2005/0031359 A1 2/2005 Ishii
2006/0034625 A1 * 2/2006 Kajikawa ..... 399/12
2006/0193643 A1 * 8/2006 Takagi et al. ..... 399/12

(Continued)

FOREIGN PATENT DOCUMENTS

CN 1580971 A 2/2005

(Continued)

*Primary Examiner*—Sophia S Chen
(74) *Attorney, Agent, or Firm*—Oliff & Berridge, PLC

(57) ABSTRACT

When a new developer cartridge is initially mounted in an image-forming device, a toothed part of a sensor gear disposed in the cartridge is brought into meshing engagement with an agitator drive gear disposed in the image-forming device. The sensor gear is driven while its toothed part is in meshing engagement with the agitator drive gear and driving of the sensor gear is stopped when its toothless part opposes the agitator drive gear. One or more contact protrusions are formed on the sensor gear to be movable therewith. An information-detecting mechanism detects how many contact protrusions are formed on the sensor gear during driving of the sensor gear. Based on the detection results, whether the mounted developer cartridge is a new product or not is determined, and information on the maximum sheets to be printed with the mounted developer cartridge is acquired.

39 Claims, 12 Drawing Sheets

U.S. PATENT DOCUMENTS

| | | | | |
|---|---|---|---|---|
| 2006/0193644 | A1* | 8/2006 | Takagi | 399/12 |
| 2006/0193645 | A1* | 8/2006 | Kishi | 399/12 |

FOREIGN PATENT DOCUMENTS

| | | | |
|---|---|---|---|
| EP | 0 262 640 | A2 | 4/1988 |
| EP | 0 344 072 | A2 | 5/1989 |
| EP | 1 107 073 | A2 | 6/2001 |
| EP | 1 505 459 | A1 | 2/2005 |
| JP | A-1-205175 | | 8/1989 |
| JP | A-5-204195 | | 8/1993 |
| JP | A 06-194907 | | 7/1994 |
| JP | A 07-152307 | | 6/1995 |
| JP | A 08-095468 | | 4/1996 |
| JP | A 08-160835 | | 6/1996 |
| JP | A-8-226517 | | 9/1996 |
| JP | A-8-248861 | | 9/1996 |
| JP | A-10-3241 | | 1/1998 |
| JP | A-2000-81814 | | 3/2000 |
| JP | A 2000-221781 | | 8/2000 |
| JP | A 2000-221866 | | 8/2000 |
| JP | A 2001-083846 | | 3/2001 |
| JP | A-2001-228692 | | 8/2001 |
| JP | A 2001-290357 | | 10/2001 |
| JP | A 2002-049291 | | 2/2002 |
| JP | A 2002-278249 | | 9/2002 |
| JP | A-2003-307932 | | 10/2003 |
| JP | A 2003-316227 | | 11/2003 |

* cited by examiner

| DETECTION NUMBER | 1 | 2 |
|---|---|---|
| TONER CAPACITY | HIGH CAPACITY | LOW CAPACITY |

107

IMAGE-FORMING DEVICE CAPABLE OF DETERMINING INFORMATION ON A DETACHABLY MOUNTED DEVELOPER CARTRIDGE AND DEVELOPER CARTRIDGE FOR USE THEREIN

CROSS REFERENCE TO RELATED APPLICATION

This application claims priorities from Japanese Patent Applications No. 2005-055104, filed Feb. 28, 2005 and No. 2005-180962, filed Jun. 21, 2005, the entire subject matter of which is incorporated herein by reference.

BACKGROUND OF THE INVENTION

1. Field of the Invention

The present invention relates to an image-forming device such as a laser printer, and a developer cartridge detachably mounted in the image-forming device.

2. Description of the Related Art

In conventional laser printers, developer cartridges accommodating toner are detachably mounted therein. This type of laser printer is provided with new product detecting means for detecting whether the developer cartridge mounted in the laser printer is a new product and for determining the life of the developer cartridge from the point that the new product was detected.

For example, Japanese unexamined patent application publication No. 2000-221781 proposes a developer cartridge that is provided with a sector gear having a recessed part and a protruding part. When the new developer cartridge is mounted in the body of an electrophotographic image-forming device, the protruding part formed on the sector gear is inserted into a new product side sensor, turning the new product side sensor on. After the developer cartridge has been mounted in the body of the image-forming device, an idler gear is driven to rotate. When the idler gear begins to rotate, the sector gear also rotates, moving the protruding part from the new product side sensor to an old product side sensor. The protruding part is inserted into the old product side sensor, turning the old product side sensor on. At the same time, the idler gear arrives at the recessed part of the sector gear, and the sector gear stops rotating.

However, in the new product detecting means described in Japanese unexamined patent application publication No. 2000-221781, both a new product side sensor and an old product side sensor are essential because the protruding part is inserted either into the new product sensor for detecting a new product or the old product sensor for detecting an old product. Accordingly, this structure increases the cost and complexity of the developing device.

Further, some users have requested the freedom to select an optimum developer cartridge from a plurality of developer cartridges in different price ranges corresponding to the amount of toner accommodated therein with consideration for cost and frequency of use.

To meet this demand, developer cartridges accommodating different amounts of toner must be provided. However, since the toner accommodated in these developer cartridges has different agitation properties based on the amount of toner, rates of degradation of the toner is also different based on the amount of toner.

Under these circumstances, it is not sufficient merely to detect whether the developer cartridge is a new product since the life of the developer cartridge from this point of detection may differ according to the amount toner accommodated therein. Accordingly, the life of the developer cartridge cannot be accurately determined. As a result, a developer cartridge accommodating a small amount of toner may actually reach the end of its life before such a determination is made, resulting in a decline in image quality.

SUMMARY

In view of the foregoing, it is an object of one aspects of the present invention to provide an image-forming device capable of determining information on a developer cartridge, while suppressing a rise in manufacturing costs and avoiding an increase in structural complexity. It is another object of the present invention to provide a developer cartridge detachably mounted in the image-forming device.

In order to attain the above and other objects, one aspect of the present invention provides an image-forming device including a body, a developer cartridge, a motor, a driving member, a moving member, an information detecting section and a controller. The developer cartridge accommodates developer therein and is detachable from the body. The motor generates a driving force. The driving member is disposed in the developer cartridge and capable of being driven by the motor a prescribed distance from a starting position to an ending position when the developer cartridge is mounted in the body. The moving member is provided in association with the driving member so as to be movable together with the driving member. The information detecting section detects the moving member as the moving member moves together with the driving member and outputs detection results. The controller acquires information on the developer cartridge based on the detection results output from the information detecting section.

Another aspect of the invention provides an image-forming device including a body, a developer cartridge, a motor, a driving member, a moving member, an information detecting section and a controller. The developer cartridge accommodates developer therein and is detachable from the body. The motor generates a driving force. The driving member is disposed in the developer cartridge and capable of being driven by the motor a prescribed distance from a starting position to an ending position when the developer cartridge is mounted in the body. The moving member is provided in association with the driving member so as to be movable together with the driving member. The information detecting section detects the moving member as the moving member moves together with the driving member and outputs detection results. The controller acquires information on the developer cartridge based on the detection results output from the information detecting section. A first number of moving members are provided when an amount of developer accommodated in the developer cartridge is a first amount. A second number larger than the first number of moving members are provided when an amount of developer accommodated in the developer cartridge is a second amount smaller than the first amount. The controller determines that the amount of developer accommodated in the developer cartridge is the first amount when a detection number of the moving members detected by the information detecting section corresponds to the first number and determines that the amount of developer accommodated in the developer cartridge is the second amount when a detection number of the moving members corresponds to the second number.

Another aspect of the invention provides a developer cartridge detachably mountable in an image-forming device. The developer cartridge includes a driving member and a moving member. The driving member is capable of being driven from an original position to an ending position when the developer cartridge is mounted in the image-forming device. The moving member is provided in association with the driving member so as to be movable together with the driving member. While the driving member is driven from the original position to the ending position when the developer cartridge is mounted in the image forming device, the moving member passes through a position where the moving member is detected by the image forming device.

Another aspect of the invention provides a developer cartridge detachably mountable in an image-forming device. The developer cartridge includes a toothless gear and a moving member. The toothless gear is capable of being driven from an original position to an ending position when the developer cartridge is mounted in the image-forming device. The toothless gear is formed with a toothed part for receiving a driving force from a motor, and a toothless part for not receiving the driving force from the motor. The moving member is movable together with the toothless gear. The moving member is disposed within a fanned-shape member including an arcuate portion having the toothed part.

Another aspect of the invention provides a developer cartridge including a casing, a developer roller, a developer roller gear, an associated gear, and a plurality of protrusions. The developer roller has a developer roller shaft rotatably supported in the casing. The developer roller gear is fixed to the developer roller shaft. The developer roller gear is rotatable with the developer roller shaft. The associated gear is rotatably provided in the casing. The associated gear is rotatable about an axis in accordance with rotation of the developer roller drive gear. The plurality of protrusions is formed on the associated gear. Each of the plurality of the protrusions extends from a part, which is different from where the axis is, of a surface of the associated gear in a direction parallel to the axis.

Another aspect of the invention provides a developer cartridge including a casing, a developer roller, a developer roller gear, a supply roller, a supply roller gear, an agitator, an agitator gear, a gear mechanism and an associated gear. The casing has confronting side walls, the casing accommodating a developer. The developer roller has a developer roller shaft rotatably supported between the confronting side walls. The developer roller gear is fixed to the developer roller shaft. The developer roller gear is rotatable with the developer roller shaft. The supply roller is configured to supply the developer roller with the developer. The supply roller has a supply roller shaft rotatably supported between the confronting side walls. The supply roller gear is fixed to the supply roller shaft. The supply roller gear is rotatable with the supply roller shaft. The agitator is configured to stir the developer in the casing. The agitator has an agitator shaft rotatably supported between the confronting side walls. The agitator gear is fixed to the agitator shaft. The agitator gear is rotatable with the agitator shaft. The gear mechanism includes an input gear, the gear mechanism transferring a driving force from the input gear to each of the developer roller gear, the supply roller gear, and the agitator drive gear. The associated gear is rotatably provided in one of the confronting side walls. The associated gear includes a circumferential part in which a toothed part is formed, and a protrusion extending from the associated gear. The rotation of the agitator gear is configured to be transferred to the associated gear.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
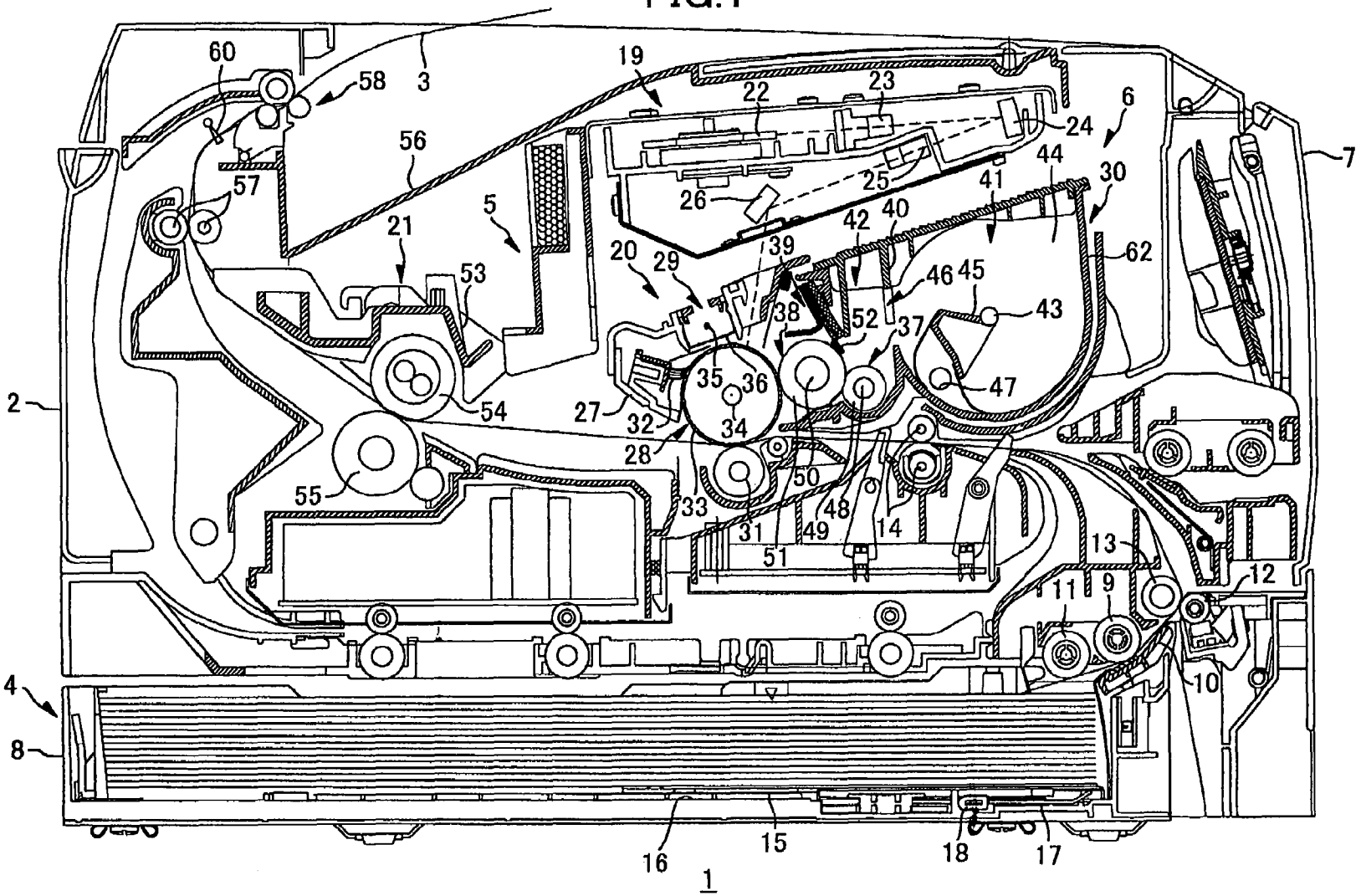
FIG. 1 is a side cross-sectional view of a laser printer according to a preferred embodiment of the present invention.

An image-forming device according to preferred embodiments of the present invention will be described while referring to the accompanying drawings wherein like parts and components are designated by the same reference numerals to avoid duplicating description.

1. Overall Structure of a Laser Printer

FIG. 1 is a side cross-sectional view of a laser printer 1 serving as the image-forming device of the present invention. As shown in FIG. 1, the laser printer 1 includes a main casing 2 and, within the main casing 2, a feeding unit 4 for supplying sheets of a paper 3, an image-forming unit 5 for forming images on the paper 3 supplied by the feeding unit 4, and the like.

(1) Main casing

An access opening 6 for inserting and removing a process cartridge 20 described later, and a front cover 7 capable of opening and closing over the access opening 6 is formed in one side wall of the main casing 2. The front cover 7 is rotatably supported by a cover shaft (not shown) inserted through a bottom end of the front cover 7. Accordingly, when the front cover 7 is rotated closed about the cover shaft, the front cover 7 covers the access opening 6, as shown in FIG. 1. When the cover is rotated open about the cover shaft (rotated downward), the access opening 6 is exposed, enabling the process cartridge 20 to be mounted into or removed from the main casing 2 via the access opening 6.

In the following description, the side of the laser printer 1 on which the front cover 7 is mounted and the corresponding side of the process cartridge 20 when the process cartridge 20 is mounted in the main casing 2 will be referred to as the "front side," while the opposite side will be referred to as the "rear side."

(2) Feeding unit

The feeding unit 4 includes a paper tray 8 that can be inserted into or removed from a lower section of the main casing 2 in the front-to-rear direction, a separating roller 9 and a separating pad 10 disposed above a front end of the paper tray 8, and a feeding roller 11 disposed on the rear side of the separating roller 9 (upstream of the separating pad 10 with respect to the conveying direction of the paper 3). The feeding unit 4 also includes a paper dust roller 12 disposed above and forward of the separating roller 9 (downstream of the separating roller 9 in the paper-conveying direction), and a pinch roller 13 disposed in opposition to the paper dust roller 12.

A paper-conveying path on the feeding end reverses directions toward the rear side of the laser printer 1, forming a substantial U-shape near the paper dust roller 12. A pair of registration rollers 14 is disposed below the process cartridge 20 farther downstream of the U-shaped portion of the paper-conveying path with respect to the paper-conveying direction.

A paper-pressing plate 15 is provided inside the paper tray 8 for supporting the paper 3 in a stacked state. The paper-pressing plate 15 is pivotably supported on the rear end thereof, so that the front end can pivot downward to a resting position in which the paper-pressing plate 15 rests on a bottom plate 16 of the paper tray 8 and can pivot upward to a supplying position in which the paper-pressing plate 15 slopes upward from the rear end to the front end.

A lever 17 is provided in the front section of the paper tray 8 for lifting the front end of the paper-pressing plate 15 upward. The rear end of the lever 17 is pivotably supported on a lever shaft 18 at a position below the front end of the paper-pressing plate 15 so that the front end of the lever 17 can pivot between a level position in which the lever 17 lies along the bottom plate 16 of the paper tray 8 and a sloped position in which the front end of the lever 17 lifts the paper-pressing plate 15 upward. When a rotational driving force is inputted into the lever shaft 18, the lever 17 rotates about the lever shaft 18 and the front end of the lever 17 raises the front end of the paper-pressing plate 15, shifting the paper-pressing plate 15 into the supplying position.

When the paper-pressing plate 15 is in the supplying position, the paper 3 stacked on the paper-pressing plate 15 is pressed against the feeding roller 11. The rotating feeding roller 11 begins feeding the sheets of paper 3 toward a separating position between the separating roller 9 and separating pad 10.

When the paper tray 8 is removed from the main casing 2, the front end of the paper-pressing plate 15 drops downward due to its own weight, moving the paper-pressing plate 15 into the resting position. While the paper-pressing plate 15 is in the resting position, the paper 3 can be stacked on the paper-pressing plate 15.

When the feeding roller 11 conveys a sheet of the paper 3 toward the separating position and the sheet becomes interposed between the separating roller 9 and the separating pad 10, the rotating separating roller 9 separates and supplies the paper 3 one sheet at a time. Each sheet of paper 3 supplied by the separating roller 9 passes between the paper dust roller 12 and pinch roller 13. After the dust roller 12 removes paper dust from the sheet of paper 3, the sheet is conveyed along the U-shaped paper-conveying path on the feeding end, thereby reversing directions in the main casing 2, and is conveyed toward the registration rollers 14.

After registering the paper 3, the registration rollers 14 convey the paper 3 to a transfer position between a photosensitive drum 28 and a transfer roller 31 described later at which a toner image formed on the photosensitive drum 28 is transferred onto the paper 3.

(3) Image-forming unit

The image-forming unit 5 includes a scanning unit 19, the process cartridge 20, and a fixing unit 21.

(a) Scanning unit

The scanning unit 19 is disposed in a top section of the main casing 2 and includes a laser light source (not shown), a polygon mirror 22 that can be driven to rotate, an fθ lens 23, a reflecting mirror 24, a lens 25, and a reflecting mirror 26. The laser light source emits a laser beam based on image data. As illustrated by a dotted line in FIG. 1, the laser beam is deflected by the polygon mirror 22, passes through the fθ lens 23, is reflected by the reflecting mirror 24, passes through the lens 25, and is reflected downward by the reflecting mirror 26 to be irradiated on the surface of the photosensitive drum 28 in the process cartridge 20.

(b) Process cartridge

The process cartridge 20 is detachably mounted in the main casing 2 beneath the scanning unit 19. The process cartridge 20 includes a process frame 27 and, within the process frame 27, the photosensitive drum 28, a Scorotron charger 29, a developer cartridge 30, the transfer roller 31, and a cleaning brush 32.

The photosensitive drum 28 includes a main drum body 33 that is cylindrical in shape and has a positive charging photosensitive layer formed of polycarbonate or the like on its outer surface, and a metal drum shaft 34 extending along the axial center of the main drum body 33 in the longitudinal direction of the main drum body 33. The metal drum shaft 34 is supported in the process frame 27, and the main drum body 33 is rotatably supported relative to the metal drum shaft 34. With this construction, the photosensitive drum 28 is disposed in the process frame 27 and is capable of rotating about the metal drum shaft 34. Further, the photosensitive drum 28 is driven to rotate by a driving force inputted from a motor 59 (see FIG. 2).

The charger 29 is supported on the process frame 27 diagonally above and rearward of the photosensitive drum 28. The charger 29 is disposed in opposition to the photosensitive drum 28 but separated a prescribed distance from the photosensitive drum 28 so as not to contact the same. The charger 29 includes a discharge wire 35 disposed in opposition to but separated a prescribed distance from the photosensitive drum 28, and a grid 36 provided between the discharge wire 35 and the photosensitive drum 28 for controlling the amount of corona discharge from the discharge wire 35 that reaches the photosensitive drum 28. By applying a high voltage to the discharge wire 35 for generating a corona discharge from the discharge wire 35 at the same time a bias voltage is applied to the grid 36, the charger 29 having this construction can charge the surface of the photosensitive drum 28 with a uniform positive polarity.

The developer cartridge 30 includes a casing 62 and, within the casing 62, a supply roller 37, a developing roller 38, and a thickness-regulating blade 39.

The developer cartridge 30 is detachably mounted on the process frame 27. Hence, when the process cartridge 20 is mounted in the main casing 2, the developer cartridge 30 can be mounted in the main casing 2 by first opening the front cover 7 and subsequently inserting the developer cartridge 30 through the access opening 6 and mounting the developer cartridge 30 on the process cartridge 20.

The casing 62 has a box shape that is open on the rear side. A partitioning plate 40 is provided midway in the casing 62 in the front-to-rear direction for partitioning the interior of the casing 62. The front region of the casing 62 partitioned by the partitioning plate 40 serves as a toner-accommodating chamber 41 for accommodating toner, while the rear region of the casing 62 partitioned by the partitioning plate 40 serves as a developing chamber 42 in which are provided the supply roller 37, the developing roller 38, and the thickness-regulating blade 39. An opening 46 is formed below the partitioning plate 40 to allow the passage of toner in a front-to-rear direction.

The toner-accommodating chamber 41 is filled with a non-magnetic, single-component toner having a positive charge. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

An agitator rotational shaft 43 is disposed in the center of the toner-accommodating chamber 41. The agitator rotational shaft 43 is rotatably supported in side walls 44 of the casing 62. The side walls 44 confront each other laterally (direction orthogonal to the front-to-rear direction and vertical direction) but are separated from each other by a prescribed distance. An agitator 45 is disposed on the agitator rotational shaft 43. The motor 59 (see FIG. 2) produces a driving force that is inputted into the agitator rotational shaft 43 for driving the agitator 45 to rotate. When driven to rotate, the agitator 45 stirs the toner inside the toner-accommodating chamber 41 so that some of the toner is discharged toward the supply roller 37 through the opening 46 formed below the partitioning plate 40.

Toner detection windows 47 are provided in both side walls 44 of the casing 62 at positions corresponding to the toner-accommodating chamber 41 for detecting the amount of toner remaining in the toner-accommodating chamber 41. The toner detection windows 47 oppose each other laterally across the toner-accommodating chamber 41. A toner sensor (not shown) having a light-emitting element and a light-receiving element is disposed in the main casing 2. The light-emitting element (not shown) is provided on the main casing 2 outside one of the toner detection windows 47, while a light-receiving element (not shown) is provided on the main casing 2 outside the other of the toner detection windows 47. Light emitted from the light-emitting element passes into the toner-accommodating chamber 41 through one of the toner detection windows 47. The light-receiving element detects this light as a detection light when the light passes through the toner-accommodating chamber 41 and exits the other toner detection window 47. The toner sensor determines the amount of remaining toner based on the frequency that the light-receiving element detects this detection light. When the toner sensor determines that the amount of toner remaining in the toner-accommodating chamber 41 has dropped to a low level, the laser printer 1 displays an out-of-toner warning on a control panel or the like (not shown).

The supply roller 37 is disposed rearward of the opening 46 and includes a metal supply roller shaft 48 covered by a sponge roller 49 formed of an electrically conductive foam material. The metal supply roller shaft 48 is rotatably supported in both side walls 44 of the casing 62 at a position corresponding to the developing chamber 42. The supply roller 37 is driven to rotate by a driving force inputted into the supply roller shaft 48 from the motor 59.

The developing roller 38 is disposed rearward of the supply roller 37 and contacts the supply roller 37 with pressure so that both are compressed. The developing roller 38 includes a metal developing roller shaft 50, and a rubber roller 51 formed of an electrically conductive rubber material that covers the metal developing roller shaft 50. The metal developing roller shaft 50 is rotatably supported in both side walls 44 of the casing 62 at a position corresponding to the developing chamber 42. The rubber roller 51 is more specifically formed of an electrically conductive urethane rubber or silicon rubber containing fine carbon particles, the surface of which is coated with urethane rubber or silicon rubber containing fluorine. The developing roller 38 is driven to rotate by a driving force inputted into the developing roller shaft 50 from the motor 59. A developing bias is also applied to the developing roller 38 during a developing operation.

The thickness-regulating blade 39 includes a main blade member configured of a metal leaf spring, and a pressing part 52 provided on a distal end of the main blade member. The pressing part 52 has a semicircular cross-section and is formed of an insulating silicon rubber. The thickness-regulating blade 39 is supported in the casing 62 above the developing roller 38. With this construction, the elastic force of the main blade member causes the pressing part 52 to contact the surface of the developing roller 38 with pressure.

Toner discharged through the opening 46 is supplied onto the developing roller 38 by the rotating supply roller 37. At this time, the toner is positively tribocharged between the supply roller 37 and the developing roller 38. As the developing roller 38 rotates, the toner supplied to the surface of the developing roller 38 passes between the rubber roller 51 of the developing roller 38 and the pressing part 52 of the thickness-regulating blade 39, thereby maintaining a uniform thickness of toner on the surface of the developing roller 38.

The transfer roller 31 is rotatably supported on the process frame 27 and opposes and contacts the photosensitive drum 28 in a vertical direction from the bottom of the photosensitive drum 28 so as to form a nip part with the photosensitive drum 28. The transfer roller 31 is configured of a metal roller shaft that is covered with a roller formed of a conductive rubber material. During a transfer operation, a transfer bias is applied to the transfer roller 31. The transfer roller 31 is driven to rotate by a driving force inputted from the motor 59.

The cleaning brush 32 is mounted on the process frame 27. The cleaning brush 32 opposes and contacts the photosensitive drum 28 on the rear side of the photosensitive drum 28.

As the photosensitive drum 28 rotates, the charger 29 charges the surface of the photosensitive drum 28 with a uniform positive polarity. Subsequently, a laser beam emitted from the scanning unit 19 is scanned at a high speed over the surface of the photosensitive drum 28, forming an electrostatic latent image corresponding to an image to be formed on the paper 3.

Next, positively charged toner carried on the surface of the developing roller 38 comes into contact with the photosensitive drum 28 as the developing roller 38 rotates and is supplied to areas on the surface of the positively charged photosensitive drum 28 that were exposed to the laser beam and, therefore, have a lower potential. In this way, the latent image on the photosensitive drum 28 is transformed into a visible image according to a reverse developing process so that a toner image is carried on the surface of the photosensitive drum 28.

As the registration rollers 14 convey a sheet of the paper 3 through the transfer position between the photosensitive drum 28 and transfer roller 31, the toner image carried on the surface of the photosensitive drum 28 is transferred onto the paper 3 by a transfer bias applied to the transfer roller 31. After the toner image is transferred, the paper 3 is conveyed to the fixing unit 21.

Toner remaining on the photosensitive drum 28 after the transfer operation is recovered by the developing roller 38. Further, paper dust deposited on the photosensitive drum 28 from the paper 3 is recovered by the cleaning brush 32.

(c) Fixing unit

The fixing unit 21 is disposed on the rear side of the process cartridge 20 and includes a fixed frame 53; and a heating roller 54 and a pressure roller 55 provided within the fixed frame 53.

The heating roller 54 includes a metal tube, the surface of which has been coated with a fluorine resin, and a halogen lamp disposed inside the metal tube for heating the same. The heating roller 54 is driven to rotate by a driving force inputted from the motor 59.

The pressure roller 55 is disposed below and in opposition to the heating roller 54 and contacts the heating roller 54 with pressure. The pressure roller 55 is configured of a metal roller shaft covered with a roller that is formed of a rubber material. The pressure roller 55 follows the rotational drive of the heating roller 54.

In the fixing unit 21, a toner image transferred onto the paper 3 at the transfer position is fixed to the paper 3 by heat as the paper 3 passes between the heating roller 54 and pressure roller 55. After the toner image is fixed to the paper 3, the heating roller 54 and pressure roller 55 continue to convey the paper 3 along a discharge end paper-conveying path toward a discharge tray 56 formed on the top surface of the main casing 2.

The discharge end paper-conveying path from the fixing unit 21 to the discharge tray 56 is substantially U-shaped for reversing the conveying direction of the paper 3 to a direction toward the front of the laser printer 1. Conveying rollers 57 are disposed at a midpoint along the discharge end paper-conveying path, and discharge rollers 58 are disposed at a downstream end of the same path. Hence, after passing through the fixing unit 21, the paper 3 is conveyed along the discharge end paper-conveying path, where the conveying rollers 57 receive and convey the paper 3 to the discharge rollers 58 and the discharge rollers 58 subsequently receive and discharge the paper 3 onto the discharge tray 56.

A paper discharge sensor 60 is disposed along the discharge end paper-conveying path between the conveying rollers 57 and the discharge rollers 58. The paper discharge sensor 60 pivots each time a sheet of paper 3 conveyed along the discharge end paper-conveying path passes the paper discharge sensor 60. A CPU 90 (see FIG. 2) provided in the main casing 2 counts the number of times that the paper discharge sensor 60 pivots and stores this number in a storage unit, such as a NVRAM 106 described later, as the number of printed sheets.

In the laser printer 1 having this construction, the CPU 90 determines whether the developer cartridge 30 mounted in the main casing 2 is a new product and determines a maximum number of sheets to be printed with the developer cartridge 30 when the developer cartridge 30 is new, as will be described later. The CPU 90 compares the actual number of printed sheets since the new developer cartridge 30 was mounted in the main casing 2 to the maximum number of sheets to be printed with the developer cartridge 30 and displays an out-of-toner warning on a control panel or the like (not shown) when the actual number of printed sheets approaches the maximum number of sheets to be printed.

Figure 2:
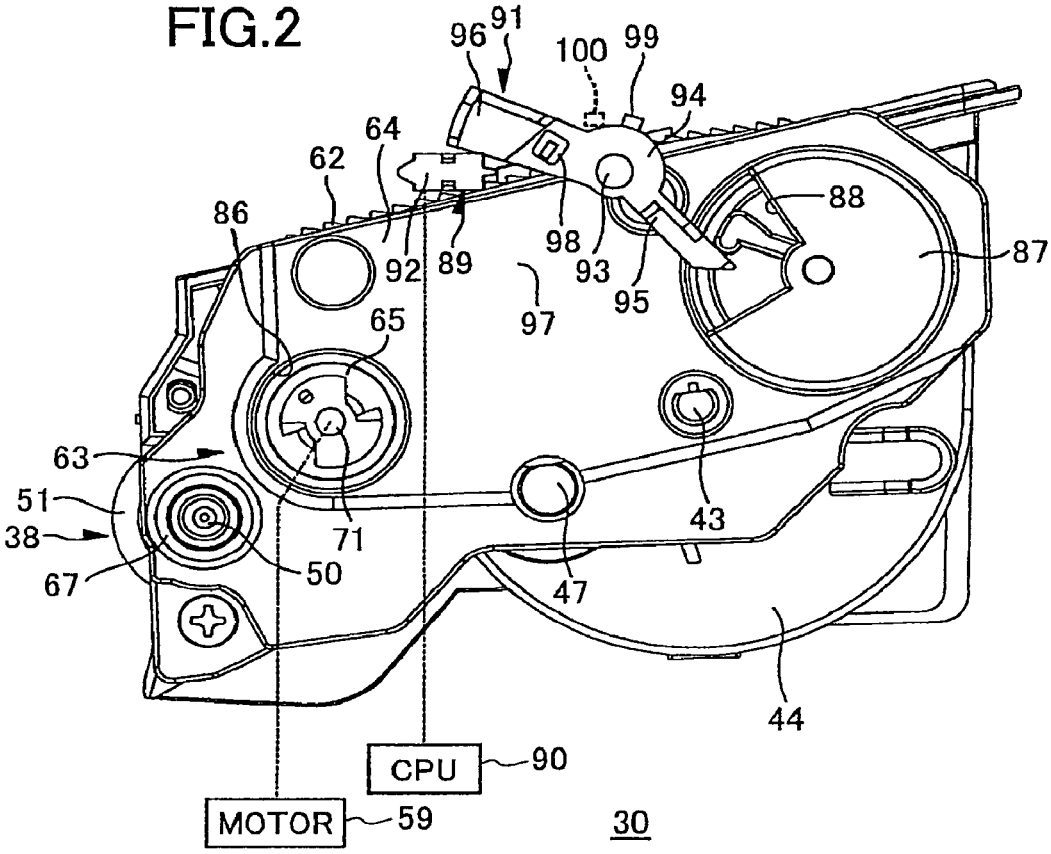
FIG. 2 is a side view of a developer cartridge in the laser printer of FIG. 1, when a gear cover is mounted thereon.
Figure 3:
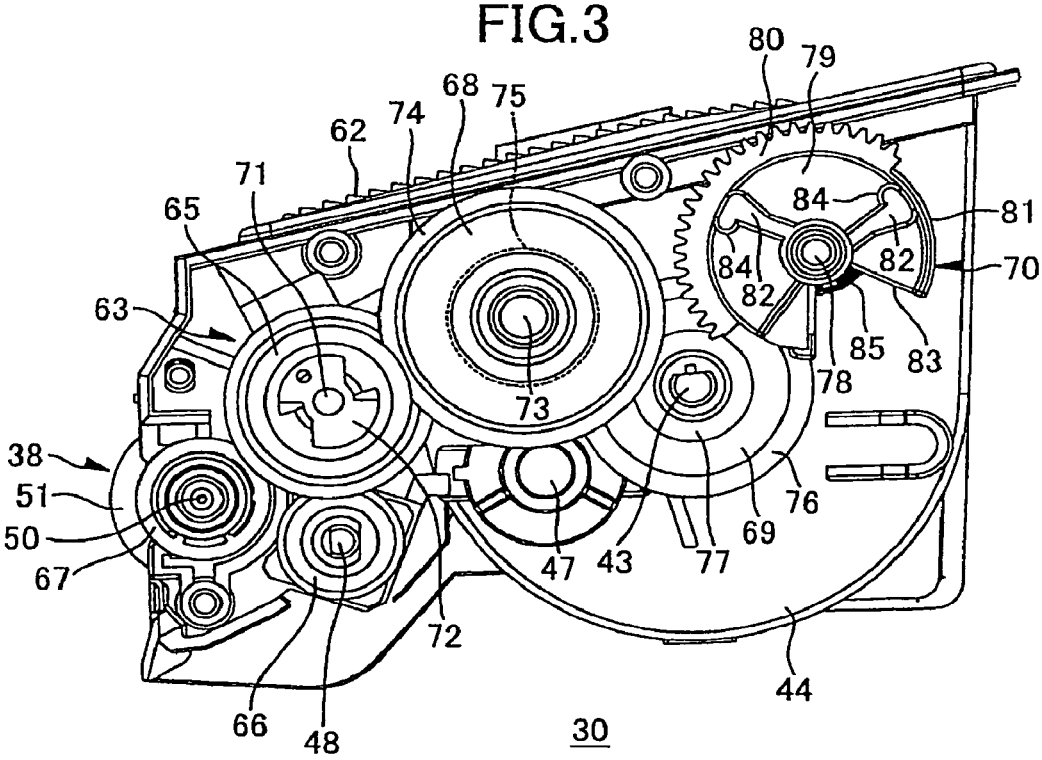
FIG. 3 is a side view of the developer cartridge when the gear cover has been removed.

2. Structure for Detecting a New Developer Cartridge (a) Structure of the developer cartridge FIG. 2 is a side view of the developer cartridge when a gear cover is mounted thereon. FIG. 3 is a side view of the developer cartridge when the gear cover has been removed. FIGS. 4A through 4F are explanatory diagrams illustrating a mechanism for detecting a new developer cartridge having two contact protrusions. FIGS. 5A through 5D are explanatory diagrams illustrating a mechanism for detecting a new developer cartridge having one contact protrusion.

As shown in FIG. 3, the developer cartridge 30 includes a gear mechanism 63 for rotating the agitator rotational shaft 43 of the agitator 45, the supply roller shaft 48 of the supply roller 37, and the developing roller shaft 50 of the developing roller 38; and a gear cover 64 for covering this gear mechanism 63, as shown in FIG. 2.

As shown in FIG. 3, the gear mechanism 63 is provided on one of the side walls 44 configuring the casing 62 of the developer cartridge 30. The gear mechanism 63 includes an input gear 65, a supply roller drive gear 66, a developer roller drive gear 67, an intermediate gear 68, an agitator drive gear 69, and a sensor gear 70.

The input gear 65 is disposed between the developing roller shaft 50 and the agitator rotational shaft 43 and is rotatably supported on an input gear support shaft 71 that protrudes laterally outward from one of the side walls 44. A coupling receiver part 72 is disposed in the axial center of the input gear 65 for inputting a driving force from the motor 59 provided on the main casing 2 when the developer cartridge 30 is mounted in the main casing 2.

The supply roller drive gear 66 is disposed below the input gear 65 on an end of the supply roller shaft 48 so as to be meshingly engaged with the input gear 65. The supply roller drive gear 66 is incapable of rotating relative to the supply roller shaft 48.

The developer roller drive gear 67 is disposed diagonally below and rearward of the input gear 65 on an end of the developing roller shaft 50 so as to be meshingly engaged with the input gear 65. The developer roller drive gear 67 is incapable of rotating relative to the developing roller shaft 50. That is, the developer roller drive gear 67 is fixed to the developing roller shaft 50 so as to be rotatable therewith.

The intermediate gear 68 is rotatably supported in front of the input gear 65 on an intermediate gear support shaft 73. The intermediate gear support shaft 73 protrudes laterally outward from one of the side walls 44. The intermediate gear 68 is a two-stage gear integrally formed of outer teeth 74 that meshingly engage with the input gear 65, and inner teeth 75 that meshingly engage with the agitator drive gear 69.

The agitator drive gear 69 is provided diagonally in front of and below the intermediate gear 68 on an end of the agitator rotational shaft 43. The agitator drive gear 69 is incapable of rotating relative to the agitator rotational shaft 43. The agitator drive gear 69 is a two-stage gear integrally formed of inner teeth 76 that meshingly engage with the inner teeth 75 of the intermediate gear 68, and outer teeth 77 that meshingly engage with the sensor gear 70.

The sensor gear 70 is rotatably supported diagonally above and forward of the agitator drive gear 69 on a sensor gear support shaft 78 that protrudes laterally outward from one of the side walls 44.

The sensor gear 70 is formed as a toothless gear integrally provided with a main sensor gear part 79, a toothed part 80, a toothless part 81, and contact protrusions 82.

The main sensor gear part 79 is disc-shaped. The sensor gear support shaft 78 is inserted through the center of the main sensor gear part 79 so that the main sensor gear part 79 is capable of rotating relative to the sensor gear support shaft 78. A substantially fan-shaped cutout part 83 is formed in part of the main sensor gear part 79, expanding radially outward from a center near the sensor gear support shaft 78.

The toothed part 80 is provided on a portion of the peripheral surface of the main sensor gear part 79. Specifically, the toothed part 80 is formed from one circumferential end of the main sensor gear part 79 to another circumferential end as an arc part corresponding to about one-half of the peripheral surface of the main sensor gear part 79. The outer teeth 77 of the agitator drive gear 69 meshingly engage with the toothed part 80 to transfer a driving force from the motor 59.

The toothless part 81 occupies the remainder of the peripheral surface of the main sensor gear part 79 not occupied by the toothed part 80. When the toothless part 81 opposes the agitator drive gear 69, the outer teeth 77 of the agitator drive gear 69 do not meshingly engage with the toothless part 81 and, hence, the transfer of the driving force from the motor 59 is interrupted.

The contact protrusions 82 are formed on the outer surface of the main sensor gear part 79 and extend radially outward from the part of the main sensor gear part 79 through which the sensor gear support shaft 78 is inserted toward the peripheral surface of the main sensor gear part 79. Each contact protrusion 82 has a base end on the sensor gear support shaft 78 side, and a distal end on the peripheral side that is broader than the base end. A projecting part 84 that is substantially L-shaped is formed on the distal end of each contact protrusion 82 and projects in the rotational direction of the sensor gear 70. The distal ends of the contact protrusions 82, including the projecting parts 84, are curved with no sharp corners.

The number of contact protrusions 82 corresponds to information on the developer cartridge 30, and specifically, information on the maximum number of sheets of paper 3 on which images can be formed with the amount of toner accommodated in the toner-accommodating chamber 41 (hereinafter referred to as the "maximum sheets to be printed") when the developer cartridge 30 is new.

More specifically, when two contact protrusions 82 are provided, as shown in FIGS. 3 and 4, this number corresponds to information indicating that the maximum sheets to be printed is 6000. When only one contact protrusion 82 is provided, as shown in FIG. 5, this number corresponds to information indicating that the maximum sheets to be printed is 3000.

Further, the contact protrusions 82 are disposed relative to the toothed part 80 of the sensor gear 70 so as to pass through a detection position of an actuator 91 described later in the rotational range of the sensor gear 70, that is, while the toothed part 80 is meshingly engaged with the outer teeth 77 of the agitator drive gear 69. More specifically, the leading contact protrusion 82 disposed upstream of the other contact protrusion 82 in the rotational direction of the sensor gear 70 (that rotates counter-clockwise) is disposed so that the distal end of the contact protrusion 82 opposes a midpoint (center) of the toothed part 80 formed on the periphery of the main sensor gear part 79. The trailing contact protrusion 82 provided on the downstream side with respect to the rotational direction of the sensor gear 70 is positioned such that the distal end of the contact protrusion 82 opposes the periphery of the sensor gear 70 just outside the downstream end of the toothed part 80 with respect to the rotational direction of the sensor gear 70.

The sensor gear 70 also includes a coil spring 85 for urging the upstream end of the toothed part 80 in the rotational direction of the sensor gear 70 to meshingly engage with the outer teeth 77 on the agitator drive gear 69 when the insertion part of the main sensor gear part 79 is rotatably fitted over the sensor gear support shaft 78.

The coil spring 85 is wound around the sensor gear support shaft 78 with one end fixed to one of the side walls 44, and the other end engaged in the cutout part 83 of the main sensor gear part 79. With this construction, the coil spring 85 constantly urges the sensor gear 70 to rotate in a direction causing the upstream end of the toothed part 80 to move toward and meshingly engage with the outer teeth 77 of the agitator drive gear 69. Hence, from the time that the developer cartridge 30 is new, the upstream end of the toothed part 80 is meshingly engaged with the outer teeth 77 of the agitator drive gear 69. The urging force of the coil spring 85 is set greater than the urging force of a tension spring 97 described later.

As shown in FIG. 2, the gear cover 64 is mounted on one of the side walls 44 of the developer cartridge 30 for covering the gear mechanism 63. An opening 86 is formed in the rear side of the gear cover 64 for exposing the coupling receiver part 72. Further, a sensor gear cover 87 is formed on the front side of the gear cover 64 for covering the sensor gear 70.

The sensor gear cover 87 swells laterally outward to accommodate the sensor gear 70. A sensing window 88 that is substantially fan-shaped is formed in a rear side portion of the sensor gear cover 87 for exposing the contact protrusions 82 as the distal ends of the contact protrusions 82 move in a circumferential direction together with the rotation of the sensor gear 70.

(b) Structure of the main casing

An information-detecting mechanism 89 and the CPU 90 (that serves as a controller) are provided on the main casing 2 for detecting and determining or decoding information on the developer cartridge 30 mounted in the main casing 2. More specifically, the information-detecting mechanism 89 and CPU 90 detect and determine data indicating whether the mounted developer cartridge 30 is a new product, and information on the maximum sheets to be printed when the developer cartridge 30 is a new product, as described above.

The information-detecting mechanism 89 is provided on an inner wall of the main casing 2 and is positioned near the rear side of the developer cartridge 30 when the developer cartridge 30 is mounted in the main casing 2, as shown in FIG. 2. As shown in FIG. 4, the information-detecting mechanism 89 includes an actuator 91 and an optical sensor 92.

The actuator 91 is pivotably supported on a pivot shaft 93 protruding laterally inward from an inner surface of the main casing 2. The actuator 91 is integrally provided with a cylindrical insertion part 94 through which the pivot shaft 93 is inserted, a contact pawl 95 extending forward from the cylindrical insertion part 94, and a light-blocking part 96 extending rearward from the cylindrical insertion part 94.

Figure 4A:
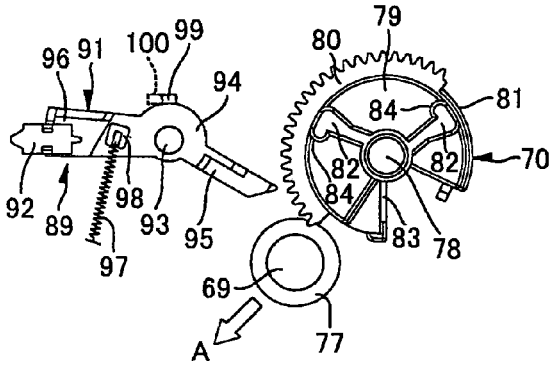
FIG. 4A is an explanatory diagram illustrating a mechanism for detecting a new developer cartridge having two contact protrusions, wherein the developer cartridge is just prior to mounting in the main casing.

As shown in FIG. 4A, the contact pawl 95 slopes slightly downward when the light-blocking part 96 is extending substantially along the horizontal. The light-blocking part 96 is formed with a thickness in the vertical direction capable of blocking detection light emitted from the optical sensor 92.

A spring engaging part 98 is formed on the light-blocking part 96 at a point midway along the length thereof. One end of a tension spring 97 is engaged in the spring engaging part 98. The tension spring 97 extends downward from the spring engaging part 98, with the other end fixed to the inner surface of the main casing 2 (not shown).

A protruding stopper 99 is formed on the peripheral surface of the cylindrical insertion part 94, protruding radially outward from the top side thereof. A stopper contact part 100 is provided on the main casing 2 near the rear side of the protruding stopper 99 for contacting the same.

As shown in FIG. 4A, the light-blocking part 96 of the actuator 91 is constantly urged downward by the tension spring 97. The urging force is restricted by the protruding stopper 99 contacting the stopper contact part 100. In this normal state, the actuator 91 is maintained such that the light-blocking part 96 extends substantially along the horizontal, while the contact pawl 95 slopes slightly downward toward the front side. In this normal state, the contact pawl 95 of the actuator 91 is disposed in a detection position for detecting passage of the contact protrusions 82.

As will be described later, the contact pawl 95 is pressed downward when the contact protrusions 82 contact the contact pawl 95 at the detection position. Accordingly, the light-blocking part 96 pivots upward and the contact pawl 95 pivots downward about the insertion part 94 in opposition to the urging force of the tension spring 97 (see FIG. 4B). As a result, the protruding stopper 99 separates from the stopper contact part 100. Subsequently, when contact between the contact protrusion 82 and contact pawl 95 is broken, the urging force of the tension spring 97 causes the light-blocking part 96 to pivot downward and the contact pawl 95 to pivot upward about the insertion part 94 until the protruding stopper 99 contacts the stopper contact part 100 (see FIG. 4C).

While not shown in FIGS. 4A through 4F, the optical sensor 92 is provided in holder members substantially U-shaped in a plan view and open on one end so that a light-emitting element and light-receiving element of the optical sensor 92 oppose each other with a gap therebetween. The optical sensor 92 is positioned such that the light-blocking part 96 of the actuator 91 is interposed between the holder members. More specifically, the optical sensor 92 is disposed such that the light-blocking part 96 blocks detection light emitted from the light-emitting element toward the light-receiving element when the actuator 91 is in its normal state (see FIG. 4A), while the detection light emitted from the light-emitting element toward the light-receiving element is received by the light-receiving element when the contact protrusion 82 contacts the contact pawl 95 and causes the light-blocking part 96 to pivot upward, as described above (see FIG. 4B).

3. Operations for Detecting a New Developer Cartridge

Next, a method will be described for determining whether a developer cartridge 30 mounted in the main casing 2 is new or old and for determining the maximum number of sheets to be printed with the developer cartridge 30.

(a) In the case of two contact protrusions

As shown in FIG. 4A, the front cover 7 is first opened, and the process cartridge 20 on which the new developer cartridge 30 is inserted into the main casing 2 through the access opening 6 in a direction A. Alternatively, the front cover 7 is opened and the new developer cartridge 30 is inserted through the access opening 6 and mounted on the process cartridge 20 already mounted in the main casing 2.

As shown in FIGS. 4A through 4F, two of the contact protrusions 82 are provided on the sensor gear 70 in the developer cartridge 30.

At the moment the developer cartridge 30 is mounted in the main casing 2, the actuator 91 is in its normal state, and the projecting part 84 of the leading contact protrusion 82 moving in a downward motion contacts the contact pawl 95 of the actuator 91 at the detection position. As a result, as shown in FIG. 4B, the actuator 91 pivots about the insertion part 94 against the urging force of the tension spring 97 so that the contact pawl 95 of the actuator 91 pivots downward and the light-blocking part 96 pivots upward in a direction B. Hence, the light-receiving element receives the detection light from the optical sensor 92, which detection light was previously blocked by the light-blocking part 96 when the actuator 91 was in its normal state.

At this time, the optical sensor 92 transmits a reception signal based on the received light to the CPU 90. The CPU 90 recognizes this reception signal as a first reception signal and resets a counter for counting the number of printed sheets.

Further, when the developer cartridge 30 is mounted in the main casing 2, a coupling insertion part (not shown) for transferring a driving force from the motor 59 provided in the main casing 2 is inserted into the coupling receiving part 72 of the input gear 65 in the developer cartridge 30. As a result, the driving force from the motor 59 drives the input gear 65, supply roller drive gear 66, developer roller drive gear 67, intermediate gear 68, agitator drive gear 69, and sensor gear 70 of the gear mechanism 63.

Next, when the developer cartridge 30 is mounted in the main casing 2, the CPU 90 initiates a warm-up operation in which an operation is executed to idly rotate the agitator 45.

In this idle rotation operation, the CPU 90 drives the motor 59 provided in the main casing 2. The driving force of the motor 59 is inputted from the coupling insertion part into the input gear 65 of the developer cartridge 30 via the coupling receiving part 72 and drives the input gear 65 to rotate. At this time, the supply roller drive gear 66 meshingly engaged with the input gear 65 is driven to rotate. The rotation of the supply roller shaft 48 in turn rotates the supply roller 37. Further, the developer roller drive gear 67 meshingly engaged with the input gear 65 is driven to rotate, and the rotation of the developing roller shaft 50 in turn rotates the developing roller 38. Further, the intermediate gear 68 meshingly engaged with the input gear 65 via the outer teeth 74 is driven to rotate, causing the inner teeth 75 formed integrally with the outer teeth 74 to rotate. When the inner teeth 75 of the intermediate gear 68 rotate, the agitator drive gear 69 meshingly engaged with the inner teeth 75 via the inner teeth 76 is driven to rotate. The rotation of the agitator rotational shaft 43 rotates the agitator 45, which stirs the toner in the toner-accommodating chamber 41 and generates a flow of toner.

When the agitator drive gear 69 is driven to rotate via the inner teeth 76, the outer teeth 77 formed integrally with the inner teeth 76 also rotate. Accordingly, since the toothed part 80 of the sensor gear 70 is meshingly engaged with the outer teeth 77, the sensor gear 70 is also driven to rotate. The sensor gear 70 rotates a prescribed amount from a starting position to a stopping position.

In other words, the sensor gear 70 is driven to rotate in a direction C only while the toothed part 80 is meshingly engaged with the outer teeth 77 of the agitator drive gear 69, the sensor gear 70 halts after being driven to rotate in a single direction about the sensor gear support shaft 78 for approximately one-half of a rotation corresponding to the toothed part 80 formed on half the peripheral surface of the main sensor gear part 79. After halting, the main sensor gear part 79 is maintained in a halted state by frictional resistance with the sensor gear support shaft 78.

With this configuration, when the developer cartridge 30 is first mounted in the main casing 2 and the sensor gear 70 is first driven to rotate, the projecting part 84 on the leading contact protrusion 82 of the sensor gear 70 contacts the contact pawl 95 and moves in a direction same as a direction in which the contact pawl 95 moves in a point of contact, that is, from top to bottom, as shown in FIG. 4B. The projecting part 84 further presses the contact pawl 95 while sliding along the same and subsequently passes and separates from the contact pawl 95, as shown in FIG. 4C. Accordingly, when contact between the projecting part 84 and contact pawl 95 is removed, the urging force of the tension spring 97 causes the actuator 91 to pivot about the insertion part 94 in a direction D so that the contact pawl 95 moves upward and the light-blocking part 96 moves downward until the actuator 91 returns to its normal state. At this time, the light-blocking part 96 once again blocks the detection light of the optical sensor 92 that had been received by the light-receiving element.

Figure 4D:
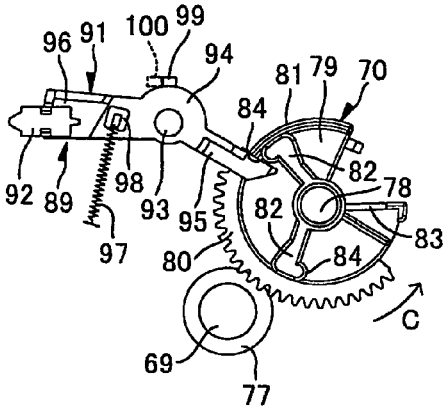
FIG. 4D is an explanatory diagram illustrating a mechanism for detecting a new developer cartridge having two contact protrusions, wherein the trailing contact protrusion is just prior to contacting the actuator.
Figure 4B:
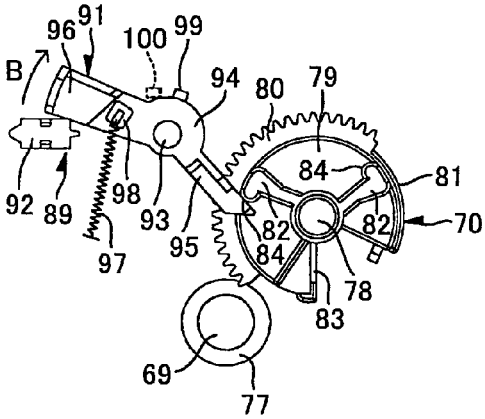
FIG. 4B is an explanatory diagram illustrating a mechanism for detecting a new developer cartridge having two contact protrusions, wherein the developer cartridge is mounted in the main casing so that the leading contact protrusion is in contact with an actuator.
Figure 4E:
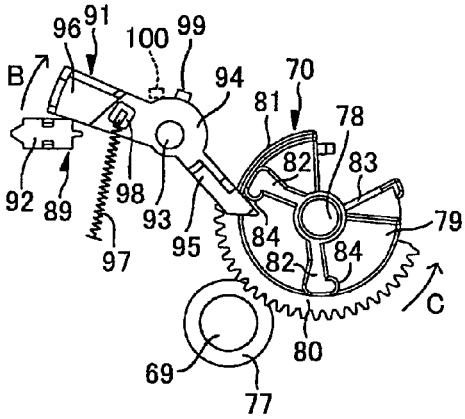
FIG. 4E is an explanatory diagram illustrating a mechanism for detecting a new developer cartridge having two contact protrusions, wherein the trailing contact protrusion is in contact with the actuator.
Figure 4C:
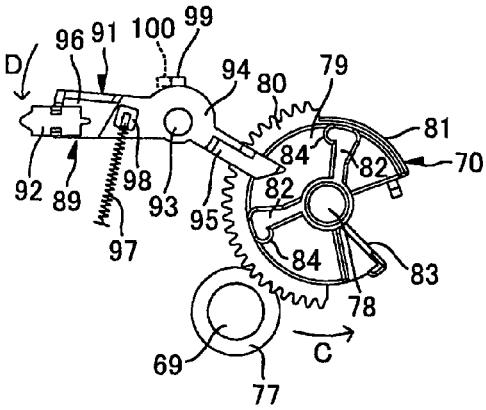
FIG. 4C is an explanatory diagram illustrating a mechanism for detecting a new developer cartridge having two contact protrusions, wherein the leading contact protrusion passes the actuator.

As the sensor gear 70 is further driven to rotate, the projecting part 84 of the trailing contact protrusion 82 subsequently contacts the contact pawl 95 of the actuator 91 in its normal state in a downward direction at the detection position, as shown in FIG. 4D. As shown in FIG. 4E, the actuator 91 is again forced to pivot about the insertion part 94 against the urging force of the tension spring 97 so that the contact pawl 95 moves downward and the light-blocking part 96 moves upward. As a result, the light-receiving element receives the detection light of the optical sensor 92. The optical sensor 92 transmits a reception signal based on this received light to the CPU 90. The CPU 90 recognizes this reception signal as a second reception signal.

Figure 4F:
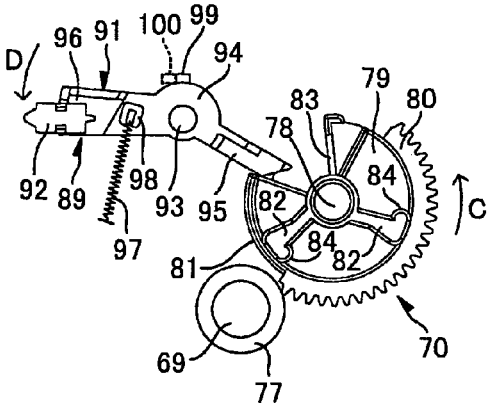
FIG. 4F is an explanatory diagram illustrating a mechanism for detecting a new developer cartridge having two contact protrusions, wherein the trailing contract protrusion is after passing the actuator.

Subsequently, the projecting part 84 further presses the contact pawl 95 while sliding along the contact pawl 95 and subsequently passes and separates from the contact pawl 95, as shown in FIG. 4F. Accordingly, when contact between the projecting part 84 and contact pawl 95 is broken, the urging force of the tension spring 97 causes the actuator 91 to pivot about the insertion part 94 so that the contact pawl 95 moves upward and the light-blocking part 96 moves downward until the actuator 91 returns to its normal state. At this time, the light-blocking part 96 once again blocks the detection light of the optical sensor 92 that had been received by the light-receiving element.

Subsequently, the toothed part 80 of the sensor gear 70 disengages from the outer teeth 77 of the agitator drive gear 69, halting rotation of the sensor gear 70. At this time, the warm-up operation, including the idle rotation operation, ends.

During this idle rotation operation, the CPU 90 determines whether the developer cartridge 30 is a new product based on whether a reception signal is inputted from the optical sensor 92, and determines the maximum number of sheets to be printed by the developer cartridge 30 based on the number of inputted reception signals.

More specifically, in the example shown in FIGS. 4A through 4F, the CPU 90 determines that the developer cartridge 30 is new upon recognizing the first reception signal, as described above.

Further, the CPU 90 associates the number of inputted reception signals with information regarding the maximum number of sheets to be printed. Specifically, when two reception signals are inputted, for example, the CPU 90 associates this number to a maximum of 6000 sheets to be printed. When a single reception signal is inputted, the CPU 90 associates this number to a maximum of 3000 sheets to be printed.

In the example described above for FIGS. 4A through 4F, the CPU 90 recognizes the first and second reception signals during the idle rotation operation. Since two reception signals were recognized, the CPU 90 determines that the maximum number of sheets to be printed with the developer cartridge 30 is 6000.

Hence, when the developer cartridge 30 is mounted in the example of FIGS. 4A through 4F, the CPU 90 determines that the developer cartridge 30 is new and determines that the maximum number of sheets to be printed with the developer cartridge 30 is 6000. The CPU 90 displays an out-of-toner warning on a control panel or the like (not shown) when the actual number of printed sheets detected by the paper discharge sensor 60 after the developer cartridge 30 was mounted approaches 6000.

However, if a new developer cartridge 30 mounted in the main casing 2 is later removed temporarily to clear up a paper jam or the like, and subsequently remounted, the sensor gear 70 is still maintained in a halted state with the toothed part 80 in a position not engaged with the outer teeth 77 of the agitator drive gear 69 (see FIG. 4F). Therefore, when the developer cartridge 30 is remounted, the sensor gear 70 is not driven to rotate should the CPU 90 execute an idle rotation operation and, hence, neither of the contact protrusions 82 passes the detection position of the actuator 91. Accordingly, the optical sensor 92 does not input a reception signal into the CPU 90, thereby preventing the CPU 90 from misinterpreting the remounted developer cartridge 30 (old developer cartridge) as a new product, enabling the CPU 90 to continue comparing the maximum number of sheets to be printed, originally determined when the developer cartridge 30 was determined to be new, with the actual number of printed sheets since that time.

(b) In the case of a single contact protrusion

Figure 5A:
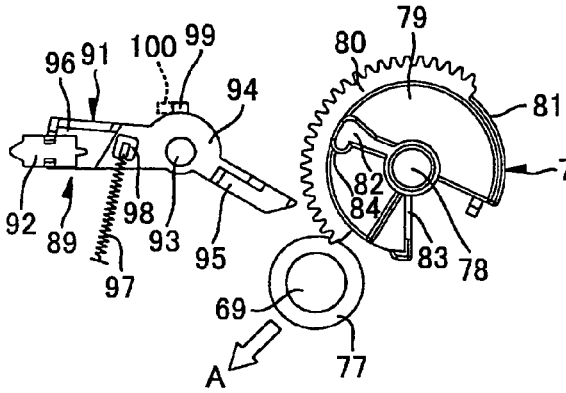
FIG. 5A is an explanatory diagram illustrating a mechanism for detecting a new developer cartridge having one contact protrusion (with a narrow width), wherein the developer cartridge is just prior to mounting in the main casing.

As shown in FIG. 5A, the front cover 7 is first opened, and the process cartridge 20 on which the new developer cartridge 30 is inserted into the main casing 2 through the access opening 6. Alternatively, the front cover 7 is opened and the new developer cartridge 30 is inserted through the access opening 6 and mounted on the process cartridge 20 already mounted in the main casing 2.

As shown in FIGS. 5A through 5D, a single contact protrusion 82 is provided on the sensor gear 70 in the developer cartridge 30. This single contact protrusion 82 corresponds to the leading contact protrusion 82 of the two contact protrusions 82 shown in FIGS. 4A through 4F. Hence, the trailing contact protrusion 82 in FIGS. 4A through 4F is not provided in the example of FIGS. 5A through 5D.

Figure 5C:
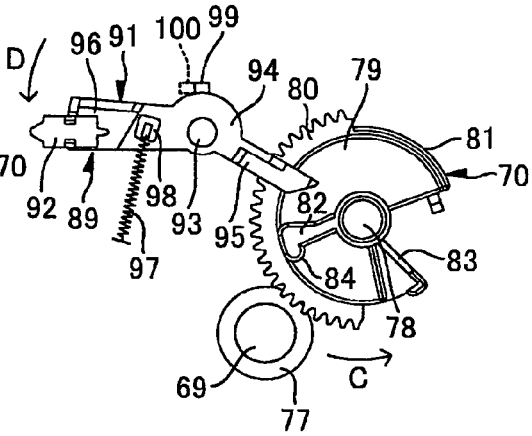
FIG. 5C is an explanatory diagram illustrating a mechanism for detecting a new developer cartridge having one contact protrusion (with a narrow width), wherein the contact protrusion is after passing the actuator.
Figure 5B:
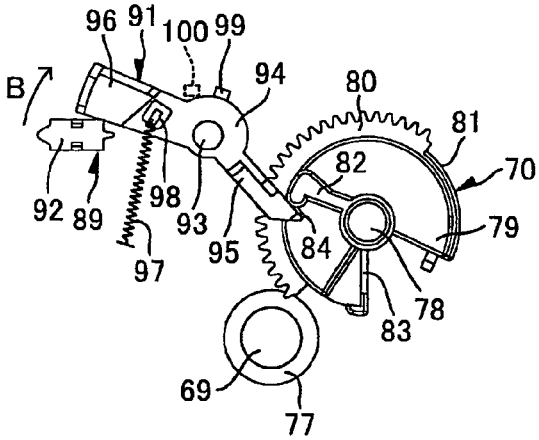
FIG. 5B is an explanatory diagram illustrating a mechanism for detecting a new developer cartridge having one contact protrusion (with a narrow width), wherein the developer cartridge is mounted in the main casing so that the leading contact protrusion is in contact with an actuator.

At the moment the developer cartridge 30 is mounted in the main casing 2, the actuator 91 is in its normal state, and the projecting part 84 of the leading contact protrusion 82 moving in a downward motion contacts the contact pawl 95 of the actuator 91 at the detection position. As a result, as shown in FIG. 5B, the actuator 91 pivots about the insertion part 94 against the urging force of the tension spring 97 so that the contact pawl 95 of the actuator 91 pivots downward and the light-blocking part 96 pivots upward. Hence, the light-receiving element receives the detection light from the optical sensor 92, which detection light was previously blocked by the light-blocking part 96 when the actuator 91 was in its normal state.

At this time, the optical sensor 92 transmits a reception signal based on the received light to the CPU 90. The CPU 90 recognizes this reception signal as a first reception signal.

Further, when the developer cartridge 30 is mounted in the main casing 2, a coupling insertion part (not shown) for transferring a driving force from the motor 59 provided in the main casing 2 is inserted into the coupling receiving part 72 of the input gear 65 in the developer cartridge 30. As a result, the driving force from the motor 59 drives the input gear 65, supply roller drive gear 66, developer roller drive gear 67, intermediate gear 68, agitator drive gear 69, and sensor gear 70 of the gear mechanism 63.

Next, when the developer cartridge 30 is mounted in the main casing 2, the CPU 90 initiates a warm-up operation in which an operation is executed to idly rotate the agitator 45.

In the idle rotation operation, the sensor gear 70 is driven to rotate only while the toothed part 80 is meshingly engaged with the outer teeth 77 of the agitator drive gear 69, as described above. Hence, the sensor gear 70 halts after being driven to rotate in a single direction about the sensor gear support shaft 78 for approximately one-half of a rotation corresponding to the toothed part 80 formed on half the peripheral surface of the main sensor gear part 79. After halting, the main sensor gear part 79 is maintained in a halted state by frictional resistance with the sensor gear support shaft 78.

With this configuration, when the developer cartridge 30 is first mounted in the main casing 2 and the sensor gear 70 is first driven to rotate, the projecting part 84 on the leading contact protrusion 82 of the sensor gear 70 contacts the contact pawl 95 and moves in a direction same as a direction in which the contact pawl 95 moves at the point of contact, that is, from top to bottom, as shown in FIG. 5B. The projecting part 84 further presses the contact pawl 95 while sliding along the same and subsequently passes and separates from the contact pawl 95, as shown in FIG. 5C. Accordingly, when contact between the projecting part 84 and contact pawl 95 is removed, the urging force of the tension spring 97 causes the actuator 91 to pivot about the insertion part 94 so that the contact pawl 95 moves upward and the light-blocking part 96 moves downward until the actuator 91 returns to its normal state. At this time, the light-blocking part 96 once again blocks the detection light of the optical sensor 92 that had been received by the light-receiving element.

Subsequently, the toothed part 80 of the sensor gear 70 disengages from the outer teeth 77 of the agitator drive gear 69, halting rotation of the sensor gear 70. At this time, the warm-up operation including the idle rotation operation ends.

During this idle rotation operation, the CPU 90 determines whether the developer cartridge 30 is a new product based on whether a reception signal is inputted from the optical sensor 92, as described above, and determines the maximum number of sheets to be printed by the developer cartridge 30 based on the number of inputted reception signals.

More specifically, in the example shown in FIGS. 5A through 5D, the CPU 90 determines that the developer cartridge 30 is new upon recognizing the first reception signal.

In the example of FIGS. 5A through 5D, the CPU 90 recognizes the first reception signal during the idle rotation operation. Since only one reception signal is recognized, the CPU 90 determines that the maximum number of sheets to be printed with the developer cartridge 30 is 3000.

Hence, when the developer cartridge 30 is mounted in the example of FIGS. 5A through 5D, the CPU 90 determines that the developer cartridge 30 is new and determines that the maximum number of sheets to be printed with the developer cartridge 30 is 3000. The CPU 90 displays an out-of-toner warning on a control panel or the like (not shown) when the actual number of printed sheets detected by the paper discharge sensor 60 after the developer cartridge 30 was mounted approaches 3000.

Figure 5D:
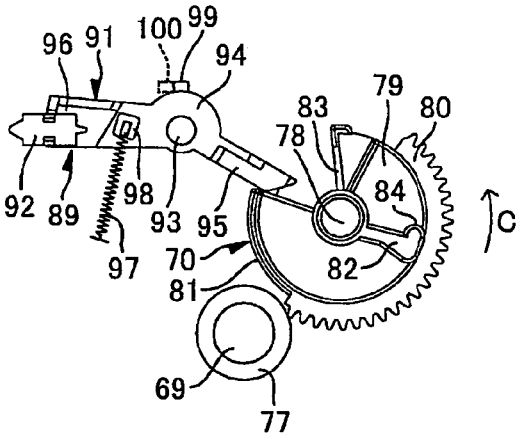
FIG. 5D is an explanatory diagram illustrating a mechanism for detecting a new developer cartridge having one contact protrusion (with a narrow width), wherein the sensor gear is just prior to halting.

However, if a new developer cartridge 30 mounted in the main casing 2 is later removed temporarily to clear up a paper jam or the like, and subsequently remounted, the sensor gear 70 is still maintained in a halted state with the toothed part 80 in a position not engaged with the outer teeth 77 of the agitator drive gear 69 (see FIG. 5D). Therefore, when the developer cartridge 30 is remounted, the sensor gear 70 is not driven to rotate should the CPU 90 execute an idle rotation operation and, hence, the contact protrusion 82 does not pass the detection position of the actuator 91. Accordingly, the optical sensor 92 does not input a reception signal into the CPU 90, thereby preventing the CPU 90 from misinterpreting the remounted developer cartridge 30 (old developer cartridge) as a new product, enabling the CPU 90 to continue comparing the maximum number of sheets to be printed, originally determined when the developer cartridge 30 was determined to be new, with the actual number of printed sheets since that time.

4. Effects of the Method for Detecting a New Developer Cartridge

With the laser printer 1 described above, the motor 59 drives the sensor gear 70 to rotate exactly one-half a rotation from a starting position to an ending position when the developer cartridge 30 is mounted in the main casing 2. While the sensor gear 70 is driven, the contact protrusion 82 moves circumferentially and passes the detection position of the actuator 91. The optical sensor 92 detects the passage of the contact protrusion 82. The CPU 90 determines whether the developer cartridge 30 is new based on whether the optical sensor 92 detected the contact protrusion 82. Therefore, a laser printer 1 capable of determining whether the developer cartridge 30 is new can be produced with reduced manufacturing costs through a simple construction.

Further, since the contact pawl 95 of the actuator 91 allows passage of the contact protrusion 82 while detecting this passage, the laser printer 1 may be provided with a plurality of contact protrusions 82 and may allow the plurality of contact protrusions 82 to pass the contact pawl 95. As a result, the CPU 90 can determine whether the developer cartridge 30 is a new product and can determine the maximum number of sheets to be printed with the developer cartridge 30 when the developer cartridge 30 is a new product based on whether the optical sensor 92 detects the plurality of contact protrusions 82.

Moreover, since the contact protrusions 82 are disposed on the sensor gear 70 so as to oppose a midpoint of the toothed part 80, the toothed part 80 can be configured to reliably pass the detection position by driving the sensor gear 70 a smaller amount than when the contact protrusion 82 opposes an end part of the toothed part 80.

Further, since the projecting part 84 of the contact protrusion 82 moves circumferentially in the same direction at which the projecting part 84 contacts the contact pawl 95 of the actuator 91, that is, the projecting part 84 moves while pushing the contact protrusion 82, the projecting part 84 can simply continue moving in the same direction after contacting the contact pawl 95. Accordingly, the laser printer 1 having this construction ensures reliably contact between the projecting part 84 and contact pawl 95.

In the laser printer 1 described above, the projecting part 84 contacts the insertion part 94 when the developer cartridge 30 is first mounted in the main casing 2. Hence, the projecting part 84 can be placed in contact with the contact pawl 95 even before the motor 59 executes the idle rotation operation. Hence, when the optical sensor 92 detects this contact, the CPU 90 can determine that the developer cartridge 30 is new without the motor 59 driving the sensor gear 70 to rotate.

Further, since the sensor gear 70 is configured of a toothless gear having the toothed part 80 and the toothless part 81, a driving force is transferred from the motor 59 to rotate the sensor gear 70 when the toothed part 80 opposes the agitator drive gear 69 and is not transferred to rotate the sensor gear 70 when the toothless part 81 opposes the agitator drive gear 69, thereby halting rotation of the sensor gear 70 at this time. Hence, the sensor gear 70 can reliably be driven a prescribed drive amount from the beginning of rotation to the end of rotation.

The developer cartridge 30 also includes the coil spring 85 for urging the sensor gear 70 toward the outer teeth 77 of the agitator drive gear 69 in order to ensure reliable engagement between the sensor gear 70 and outer teeth 77. Hence, the sensor gear 70 is reliably driven by the driving force of the motor 59 via the outer teeth 77 of the agitator drive gear 69. By ensuring that the sensor gear 70 is reliably driven, the CPU 90 can reliably determine the maximum number of sheets to be printed with the developer cartridge 30 when the developer cartridge 30 is determined to be new.

In the laser printer 1 described above, information regarding the maximum number of sheets to be printed with the developer cartridge 30 is set in correspondence with the number of contact protrusions 82 provided in the developer cartridge 30. Hence, the CPU 90 can easily and reliably determine information on the maximum number of sheets to be printed with the developer cartridge 30 based on the number of contact protrusions 82 detected by the optical sensor 92 (number of reception signals inputted). Therefore, the CPU 90 can reliably determine the life of the developer cartridge 30 to ensure that the developer cartridge 30 is replaced at a precise time, even when the amount of toner corresponding to the maximum number of sheets to be printed differs among developer cartridges 30.

Since the CPU 90 in the laser printer 1 of the preferred embodiment can determine whether the mounted developer cartridge 30 is new based on whether the optical sensor 92 has detected the contact protrusion 82 in the developer cartridge 30, the laser printer 1 of the preferred embodiment can easily and reliably determine whether the developer cartridge 30 is old or new. Accordingly, the laser printer 1 can reliably determine when the developer cartridge 30 has reached the end of its life from the point that the developer cartridge 30 was determined to be new.

5. Variation of the Contact Protrusion

In the preferred embodiment described above, the number of contact protrusions 82 is associated with the maximum number of sheets to be printed with the developer cartridge 30. However, it is also possible to associate a width at the distal end of the contact protrusion 82 (circumferential length of the distal end including the projecting part 84) with the maximum number of sheets to be printed with the developer cartridge 30, as illustrated in FIGS. 5A through 5D and 6A through 6C.

Figure 6A:
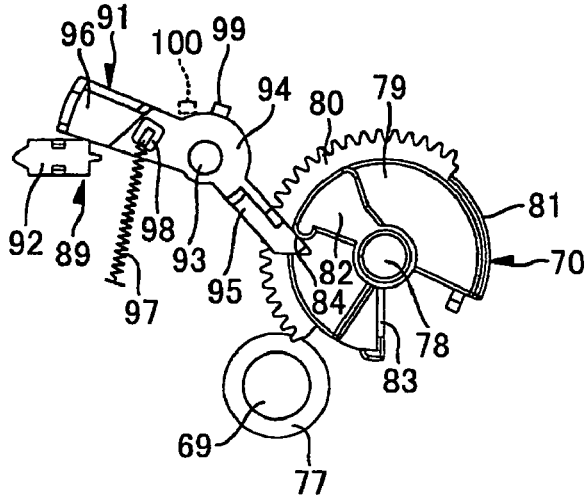
FIG. 6A is an explanatory diagram illustrating the mechanism for detecting a new developer cartridge having one contact protrusion (with a broad width), wherein the contact protrusion is in contact with the actuator.
Figure 6B:
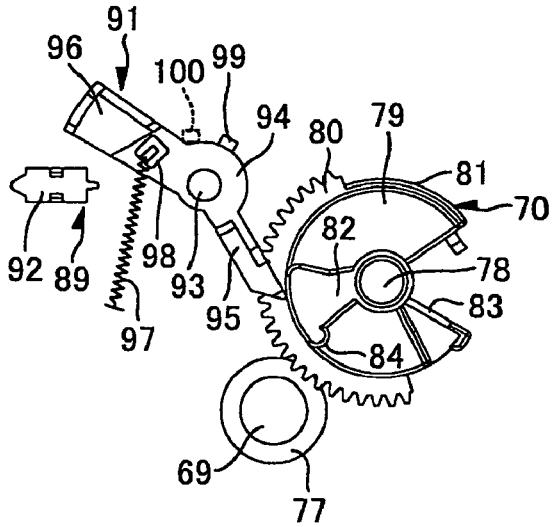
FIG. 6B is an explanatory diagram illustrating the mechanism for detecting a new developer cartridge having one contact protrusion (with a broad width), wherein the contact protrusion passes the actuator.
Figure 6C:
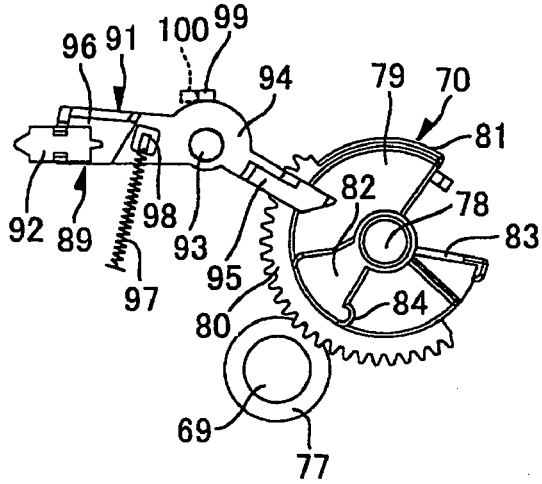
FIG. 6C is an explanatory diagram illustrating the mechanism for detecting a new developer cartridge having one contact protrusion (with a broad width), wherein the contact protrusion is after passing the actuator.

Specifically, a contact protrusion 82 formed with a wider distal end, as shown in FIGS. 6A through 6C, may be associated with information indicating a maximum number of 6000 sheets to be printed, for example. A contact protrusion 82 formed with a narrow distal end, as shown in FIGS. 5A through 5D, may be associated with information indicating a maximum number of 3000 sheets to be printed.

The CPU 90 may also determine the maximum number of sheets to be printed based on the length of input time from the point that the motor 59 is first driven for the reception signal to be inputted from the optical sensor 92.

Hence, in the idle rotation operation illustrated in FIGS. 5A through 5D, the projecting part 84 of the contact protrusion 82 is in contact with the contact pawl 95, as shown in FIG. 5B, when the sensor gear 70 is first driven to rotate. As the projecting part 84 slides along the contact pawl 95, the optical sensor 92 inputs a reception signal into the CPU 90 over a short time corresponding to the time required for the projecting part 84 to pass the contact pawl 95.

In the idle rotation operation illustrated in FIGS. 6A through 6C, the projecting part 84 of the contact protrusion 82 is in contact with the contact pawl 95 of the actuator 91 when the sensor gear 70 is first driven to rotate, as shown in FIG. 6A. However, since the projecting part 84 in the example of FIGS. 6A through 6C has a greater circumferential length, the projecting part 84 slides along the contact pawl 95 for a longer period of time, as shown in FIG. 6B. Hence, the optical sensor 92 inputs a reception signal into the CPU 90 over a longer period of time corresponding to the time required for the projecting part 84 to pass the contact pawl 95, as shown in FIG. 6C.

In this way, the CPU 90 can determine the maximum number of sheets to be printed with the developer cartridge 30 based on the input time of the reception signal. For example, the CPU 90 can determine that the maximum number of sheets to be printed is 3000 when the input time is short and that the maximum number of sheets to be printed is 6000 when the input time is long.

With this construction, the CPU 90 can determine the maximum number of sheets to be printed for different developer cartridges, based on the length of time that the optical sensor 92 detects the contact protrusion 82, simply by modifying the width of the distal end of the contact protrusion 82 for different developer cartridges, rather than by providing a plurality of contact protrusions 82.

6. Variation of the Relationship Between the Number of Contact Protrusions and the Maximum Number of Sheets to be Printed In the preferred embodiment described above, two contact protrusions 82 were associated with information indicating a maximum number of 6000 sheets to be printed, while a single contact protrusion 82 was associated with information indicating a maximum number of 3000 sheets to be printed. However, the opposite association may also be made. In other words, a single contact protrusion 82 may be associated with information indicating a maximum number of 6000 sheets to be printed, while two contact protrusions 82 may be associated with information indicating a maximum number of 3000 sheets to be printed.

Figures 7, 8:
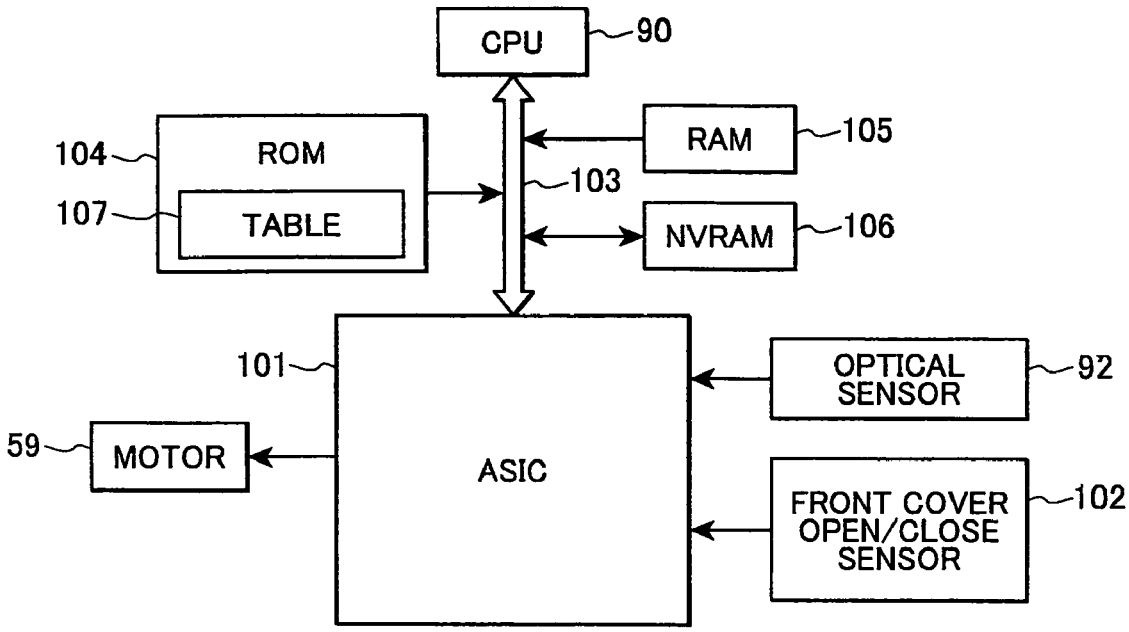
FIG. 7 is a block diagram showing a control system for controlling a new product determining process.
FIG. 8 is an explanatory diagram illustrating a table stored in a ROM in FIG. 7.
Figure 9:
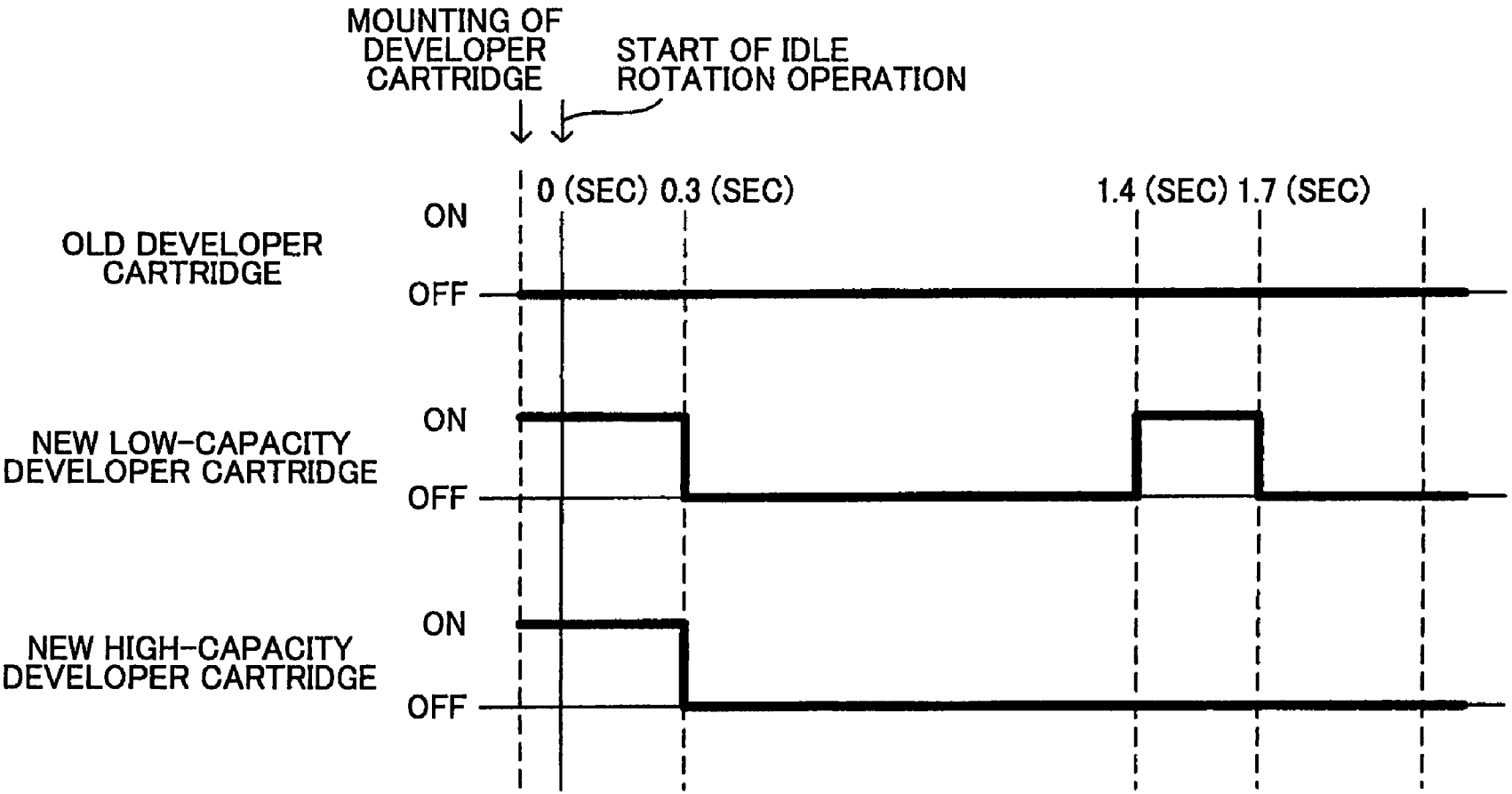
FIG. 9 is a timing chart for the new product determining process.
Figure 10:
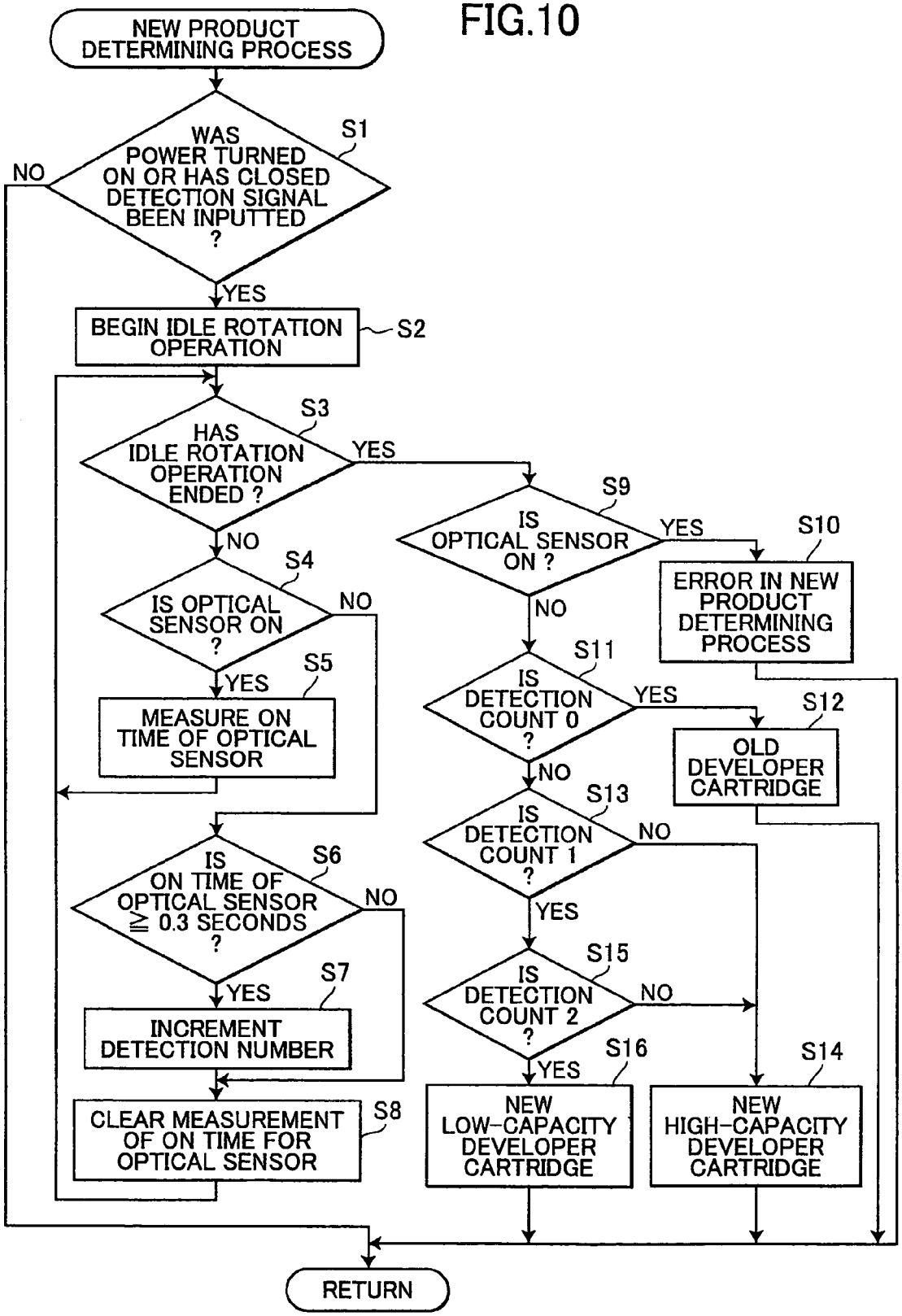
FIG. 10 is a flowchart illustrating steps in the new product determining process.

Next, a new product determining process using this relationship to determine whether the developer cartridge 30 is new and to determine the maximum number of sheets to be printed with the developer cartridge 30 will be described in detail with reference to FIGS. 7 through 10. FIG. 7 is a block diagram showing the control system for the new product determining process. FIG. 8 is a table stored in ROM indicated in FIG. 7. FIG. 9 is a timing chart for the new product determining process. FIG. 10 is a flowchart illustrating steps in the new product determining process.

As shown in FIG. 7, the control system includes an ASIC 101 for controlling the various sections of the laser printer 1; and the motor 59 and optical sensor 92 described above and a front cover open/close sensor 102 that are connected to the ASIC 101.

The ASIC 101 controls the motor 59 as the CPU 90 executes various programs.

The optical sensor 92 inputs the reception signals described above into the CPU 90 via the ASIC 101.

The front cover open/close sensor 102 is configured of a switch (not shown) that is turned on through contact with the front cover 7. The front cover open/close sensor 102 is turned on when the front cover 7 is closed from an open position, and inputs a closed detection signal into the CPU 90 via the ASIC 101.

The control system also includes a ROM 104, a RAM 105, a NVRAM 106, and the CPU 90, all of which components are connected to the ASIC 101 via a bus 103.

The ROM 104 stores various programs executed by the CPU 90, such as an image-forming program for executing an image-forming process, a new product determining program for executing the new product determining process, and a motor rotational speed determining program for executing a motor rotational speed determining process when needed. The ROM 104 also stores a table 107 that associates toner capacities of the developer cartridges 30 with a number of detections and is referenced during the new product determining process.

In the table 107 shown in FIG. 8, the number of detections corresponds to the number of times that the optical sensor 92 detects a contact protrusion 82 and inputs a reception signal into the CPU 90. As shown in FIG. 8, a detection number (hereinafter referred to as a "detection count") of "1" corresponds to "high capacity," while a detection number of "2" corresponds to "low capacity." Here, "high capacity" indicates that the developer cartridge 30 mounted in the main casing 2 has a high capacity of toner capable of printing a maximum of 6000 sheets (hereinafter referred to as a "high-capacity developer cartridge"). "Low capacity" indicates that the developer cartridge 30 mounted in the main casing 2 has a low toner capacity sufficient for printing a maximum of 3000 sheets (hereinafter referred to as a "low-capacity developer cartridge").

The RAM 105 temporarily stores numerical values and the like used when the CPU 90 executes various programs. The NVRAM 106 stores data indicating the existence of a reception signal inputted from the optical sensor 92, the length of time of the reception signal (see FIG. 9), the number of inputted reception signals (detection number), and the like.

With this control system, the CPU 90 executes the new product determining program stored in the ROM 104 to perform the new product determining process. During this process, the ASIC 101 controls the various sections of the laser printer 1.

Next, the new product determining process will be described while referring to FIGS. 9 and 10.

As described above, in this new product determining process, a developer cartridge 30 having a single contact protrusion 82 is a high-capacity developer cartridge accommodating sufficient toner to print a maximum of 6000 sheets. A developer cartridge 30 provided with two contact protrusions 82 is a low-capacity developer cartridge accommodating sufficient toner to print a maximum of 3000 sheets.

FIG. 9 illustrates the on/off timing of the optical sensor 92 when the developer cartridge mounted in the optical sensor 92 is a new high-capacity developer cartridge, a new low-capacity developer cartridge, and an old developer cartridge.

When a new high-capacity developer cartridge is mounted in the main casing 2, the projecting part 84 of the contact protrusion 82 contacts the contact pawl 95 of the actuator 91 at the detection position at the moment that the new cartridge is mounted, as described above. When the projecting part 84 contacts the contact pawl 95, the actuator 91 pivots, turning the optical sensor 92 on. In other words, the optical sensor 92 inputs a reception signal into the CPU 90.

At this time, the CPU 90 controls the motor 59 to drive at full speed, and initiates the idle rotation operation. As a result, the projecting part 84 further presses the contact pawl 95 while sliding along the same, and subsequently separates from the contact pawl 95. At this time, the actuator 91 pivots back to its normal state, turning off the optical sensor 92 (in other words, the reception signal inputted into the CPU 90 is interrupted). When the motor 59 is driven at full speed, a time of 0.3 seconds elapses from the beginning of the idle rotation operation until the optical sensor 92 is turned off.

Hence, when a new high-capacity developer cartridge is mounted in the main casing 2, the optical sensor 92 turns on and off only one time (receives light one time). Therefore, a continuous on state of a prescribed time (0.3 seconds in the preferred embodiment) during a prescribed interval from the moment the motor 59 is first driven (5 seconds, for example) is counted as one detection. This is true throughout the following description.

When a new low-capacity developer cartridge is mounted in the main casing 2, the projecting part 84 of the leading contact protrusion 82 contacts the contact pawl 95 of the actuator 91 at the detection position at the moment that the new cartridge is mounted, as described above. When the projecting part 84 contacts the contact pawl 95, the actuator 91 pivots, turning the optical sensor 92 on.

At this time, the CPU 90 controls the motor 59 to drive at full speed, and initiates the idle rotation operation. As a result, the leading projecting part 84 further presses the contact pawl 95 while sliding along the same, and subsequently separates from the contact pawl 95. At this time, the actuator 91 pivots back to its normal state, turning off the optical sensor 92. When the motor 59 is driven at full speed, a time of 0.3 seconds elapses from the beginning of the idle rotation operation until the optical sensor 92 is turned off.

Subsequently, the projecting part 84 of the trailing contact protrusion 82 contacts the contact pawl 95 of the actuator 91 in the normal state. As a result, the actuator 91 pivots and the optical sensor 92 is turned on again. When the motor 59 is driven at full speed, a time of 1.1 seconds elapses from the moment that the optical sensor 92 was turned off until the optical sensor 92 is turned on again (that is, 1.4 seconds from the beginning of the idle rotation operation until the optical sensor 92 is again turned on when the motor 59 is driven at full speed).

The trailing projecting part 84 further presses the 95 while sliding in contact with the same. Subsequently, the projecting part 84 separates from the contact pawl 95, allowing the actuator 91 to pivot back to its normal state and, consequently, turning off the optical sensor 92. When the motor 59 is driven at full speed, a time of 0.3 seconds elapses from the moment the optical sensor 92 was turned on again until the optical sensor 92 is turned off again (that is, 1.7 seconds from the beginning of the idle rotation operation until the optical sensor 92 is again turned off when the motor 59 is driven at full speed).

Hence, the detection number of the optical sensor 92 (number of times that the optical sensor 92 receives light) is two when a new low-capacity developer cartridge is mounted in the main casing 2.

When an old developer cartridge (either an old high-capacity or an old low-capacity developer cartridge) is mounted in the main casing 2, the sensor gear 70 is maintained in a halted state, as described above. Therefore, since the contact protrusion 82 does not pass through the detection position of the actuator 91, the optical sensor 92 remains in an off state.

Hence, the detection number of the optical sensor 92 is "0" when an old developer cartridge is mounted in the main casing 2.

Next, the new product determining process executed by the CPU 90 will be described with reference to FIG. 10. In S1 of the process in FIG. 10, the CPU 90 determines if either the power was turned on or the front cover open/close sensor 102 has inputted a closed detection signal into the CPU 90. If neither the power has been turned on nor the CPU 90 has received a closed detection signal (S1: NO), then the process returns to a main routine (not shown), while the determination in S1 is continually executed. However, if either the power has been turned on or the CPU 90 has received a closed detection signal (S1: YES), then in S2 the CPU 90 initiates the idle rotation operation described above.

As described above, the front cover 7 is first opened, and the developer cartridge 30 is inserted into the main casing 2 through the access opening 6. Subsequently, the front cover 7 is closed, at which time the front cover open/close sensor 102 turns on and inputs a closed detection signal into the CPU 90. At this time, the idle rotation operation in S2 begins.

After beginning the idle rotation operation, in S3 the CPU 90 determines whether the idle rotation operation has ended. If the idle rotation operation has not ended (S3: NO), that is, while the idle rotation operation is being executed, in S4 the CPU 90 determines whether the optical sensor 92 is on (whether the optical sensor 92 is inputting a reception signal). If the optical sensor 92 is on (S4: YES), then in S5 the CPU 90 measures the time during which the optical sensor 92 is on (hereinafter referred to as "the ON time of the optical sensor 92"). The ON time of the optical sensor 92 is measured continuously during the idle rotation operation while the optical sensor 92 is on, and the measured time is stored in the NVRAM 106 (S3: NO, S4: YES, S5).

However, when the optical sensor 92 is off (S4: NO), in S6 the CPU 90 determines whether the ON time of the optical sensor 92 was 0.3 seconds or greater. If the ON time of the optical sensor 92 exceeds 0.3 seconds (S6: YES), then the contact protrusion 82 has contacted the contact pawl 95 at the contact position, as described above. Hence, the CPU 90 determines that a reception signal has been inputted and in S7 increments the detection number stored in the NVRAM 106. In S8 the CPU 90 clears the measured ON time for the optical sensor 92 from the NVRAM 106.

However, if the ON time of the optical sensor 92 is less than 0.3 seconds (S6: NO), then the CPU 90 determines that the inputted signal was noise and not caused by contact between the contact protrusion 82 and contact pawl 95. Therefore, the CPU 90 does not increment the detection number in S7, but in S8 clears the measured time stored in the NVRAM 106.

After clearing the measured ON time of the optical sensor 92 in S8, the CPU 90 returns to S3 to determine again whether the idle rotation operation has ended. If the idle rotation operation has not ended (S3: NO), then the CPU 90 repeats the steps described above.

When the developer cartridge 30 mounted in the main casing 2 is an old developer cartridge, the on/off detection number of the optical sensor 92 is "0" in the idle rotation operation. Hence, in this case, the detection number is never incremented in S7, and the detection count remains at "0" when the idle rotation operation ends.

When the developer cartridge 30 mounted in the main casing 2 is a new high-capacity developer cartridge, the developer cartridge 30 has one contact protrusion 82. Hence, the on/off detection number of the optical sensor 92 during the idle rotation operation is "1", as illustrated in FIG. 9. Accordingly, the detection number is incremented once in S7, and the detection count remains at "1" when the idle rotation operation ends.

If the developer cartridge 30 mounted in the main casing 2 is a new low-capacity developer cartridge, then the developer cartridge 30 has two contact protrusions 82. Hence, the on/off operation of the optical sensor 92 is detected twice during the idle rotation operation, as illustrated in FIG. 9. Accordingly, the detection number is incremented twice in S7, and the detection count remains at "2" when the idle rotation operation ends.

When the idle rotation operation has ended (S3: YES), in S9 the CPU 90 determines whether the optical sensor 92 is on. If the optical sensor 92 is on (S9: YES), then the detection number has not been counted properly because the contact protrusion 82 remains in contact with the contact pawl 95, for example. In such a case, the CPU 90 determines in S10 that an error has occurred in the new product determining process and returns to the main routine. If the CPU 90 determines that an error has occurred during the new product determining process, then the CPU 90 displays a message indicating this message on the control panel or the like.

However, if the optical sensor 92 is off (S9: NO), then the CPU 90 determines that the detection number has been properly counted and in S11 determines whether the detection count is "0". If the detection count is "0" (S11: YES), then in S12 the CPU 90 determines that the mounted cartridge is an old developer cartridge and returns to the main routine. When the CPU 90 determines that the mounted cartridge is an old developer cartridge, the CPU 90 continues to compare the maximum number of sheets to be printed with the cartridge determined when the cartridge was new to the actual number of printed sheets since the cartridge was determined to be new, as described above.

However, if the detection count is not "0" (S11: NO), then in S13 the CPU 90 determines whether the detection count is "1". If the detection count is "1" (S13: YES), then in S14 the CPU 90 references the table 107 stored in the ROM 104 and determines that the mounted cartridge is a new high-capacity developer cartridge, because data indicating "high capacity" has been associated with the detection count of "1" in the table 107. Subsequently, the CPU 90 returns to the main routine. When the CPU 90 determines that the mounted cartridge is a new high-capacity developer cartridge, the CPU 90 determines that the developer cartridge 30 is new and that a maximum number of 6000 sheets can be printed with the developer cartridge 30, as described above. Therefore, the CPU 90 displays an out-of-toner warning on the control panel or the like when the actual number of printed sheets detected by the paper discharge sensor 60 since the developer cartridge 30 was initially mounted exceeds 6000.

If the detection count is not "1" (S13: NO), then in S15 the CPU 90 determines whether the detection count is "2". If the detection count is "2" (S15: YES), then in S16 the CPU 90 references the table 107 stored in the ROM 104 and determines that the mounted cartridge is a new low-capacity developer cartridge, because data indicating "low capacity" has been associated with the detection count of "2" in the table 107. Subsequently, the CPU 90 returns to the main routine. When the CPU 90 determines that the mounted cartridge is a new low-capacity developer cartridge, the CPU 90 determines that the developer cartridge 30 is new and that a maximum number of 3000 sheets can be printed with the developer cartridge 30, as described above. Hence, the CPU 90 displays an out-of-toner warning on the control panel or the like when the actual number of printed sheets detected by the paper discharge sensor 60 since the developer cartridge 30 was initially mounted exceeds 3000.

However, when the detection count is not "2" (S15: NO), that is, when the detection count is "3" or greater, then the detection count is not listed in the table 107. In such a case, the CPU 90 determines in S14 that the cartridge is "high capacity" and is therefore a new high-capacity developer cartridge, and the CPU 90 returns to the main routine. When the CPU 90 determines that the mounted cartridge is a new high-capacity developer cartridge, the CPU 90 determines that the developer cartridge 30 is new and that a maximum number of 6000 sheets can be printed with the developer cartridge 30, as described above. Hence, the CPU 90 displays an out-of-toner warning on the control panel or the like when the actual number of printed sheets detected by the paper discharge sensor 60 since the developer cartridge 30 was initially mounted exceeds 6000.

Since the number of on/off detections of the optical sensor 92 normally grows larger as the number of contact protrusions 82 increases, there is a danger that the CPU 90 will miss a detection signal inputted from the optical sensor 92 and determine that the detection number is less than the actual number of on/off detections in the new product determining process. Hence, when two contact protrusions 82 are provided, there is a danger that the CPU 90 will misinterpret the on/off detection number of the optical sensor 92 as "1" instead of "2" by missing a detection signal.

For example, when a high-capacity developer cartridge having two contact protrusions 82 is mounted, the CPU 90 should determine that the optical sensor 92 turns on and off twice. However, if the CPU 90 misses one reception signal, as described above, and misinterprets the number of on/off detections as "1", the CPU 90 will determine that the maximum number of sheets to be printed with the high-capacity developer cartridge is 3000 instead of the correct 6000.

In this case, the CPU 90 will display an out-of-toner warning on the control panel or the like when the actual number of printed sheets detected by the paper discharge sensor 60 approaches 3000 since the developer cartridge 30 was mounted in the main casing 2, prompting the user to replace the developer cartridge. Hence, the developer cartridge 30 will be replaced while a large amount of unused toner remains in the high-capacity developer cartridge.

However, in the new product determining process according to the preferred embodiment, a developer cartridge having a single contact protrusion 82 corresponds to a high-capacity developer cartridge, thereby reducing the danger of the CPU 90 misinterpreting the on/off detection number of the optical sensor 92 than when the high-capacity developer cartridge has two contact protrusions 82, as described above. Hence, this method can prevent the developer cartridge 30 from being replaced while a large amount of toner remains therein, as described above.

Since a cartridge with two contact protrusions 82 corresponds to a low-capacity developer cartridge in this new product determining process, there is a danger that the CPU 90 will determine that the maximum number of sheets to be printed with a low-capacity developer cartridge is 6000 instead of the correct 3000 if the CPU 90 misses a detection signal, as described above. However, the laser printer 1 of the preferred embodiment has a toner sensor for determining the actual amount of toner remaining in the toner-accommodating chamber 41, as described above. Therefore, when the actual amount of remaining toner becomes very low, the CPU 90 will display an out-of-toner warning on the control panel or the like based on the determination by the toner sensor. Hence, even if the CPU 90 misinterprets the maximum number of sheets to be printed with a low-capacity developer cartridge as 6000, the CPU 90 will display an out-of-toner warning when the actual number of printed sheets approaches 3000 based on the determination of the toner sensor, even though such a warning will not be displayed based on the actual number of printed sheets detected by the paper discharge sensor 60.

Further, when the CPU 90 determines in S15 of the new product determining process that the detection count is not "2" (S15: NO), that is, that the detection count corresponds to a number outside of the detection numbers listed in the table 107, then in S14 the CPU 90 determines that the cartridge is a new high-capacity developer cartridge. Hence, if the CPU 90 misinterprets inputted noise signal as a reception signal, resulting in the detection count exceeding the detection numbers listed in the table 107, the CPU 90 associates this count with "high capacity," thereby preventing the developer cartridge 30 from being replaced while a large amount of unused toner remains in the high-capacity developer cartridge.

Figure 11:
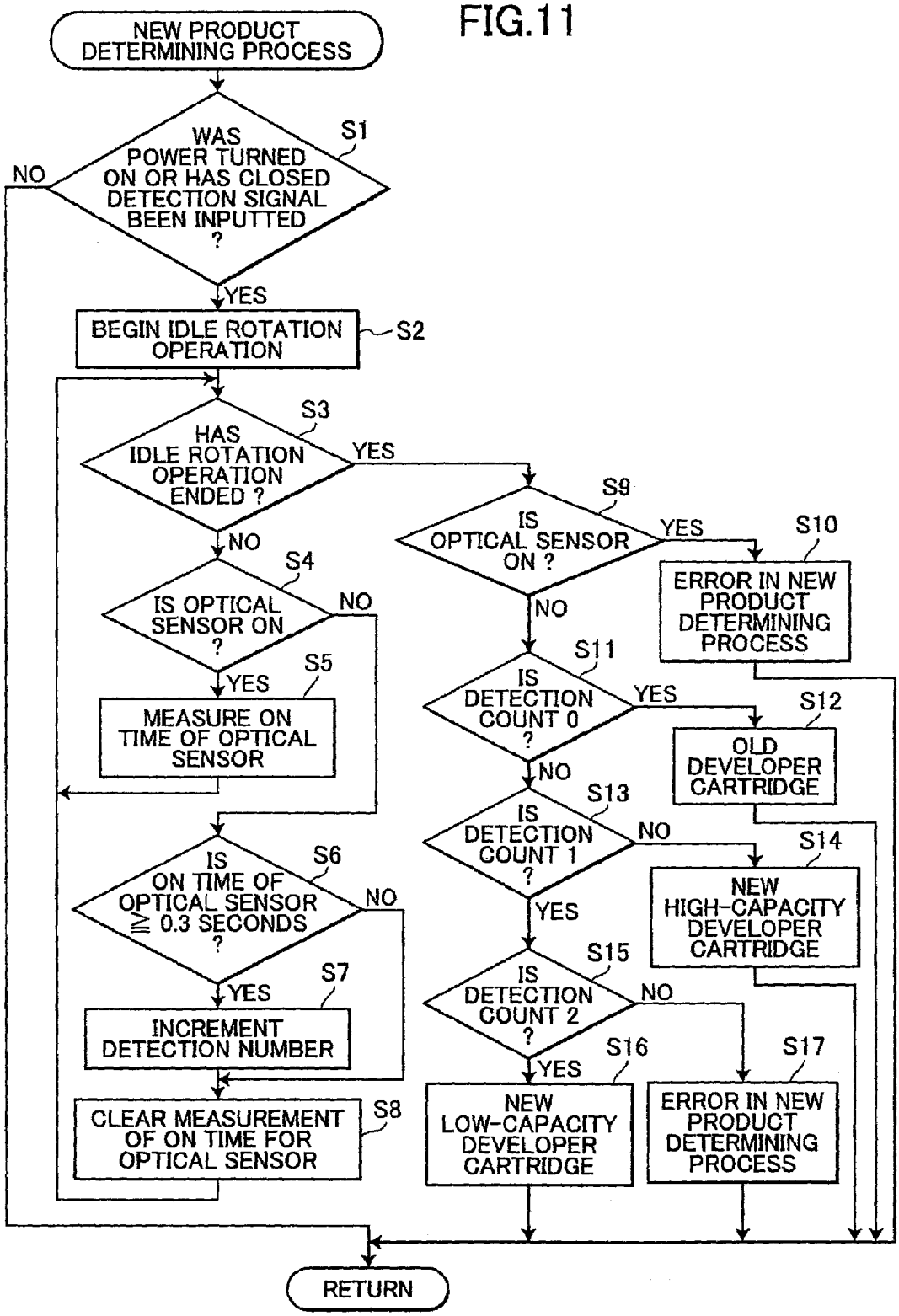
FIG. 11 is a flowchart illustrating steps in a variation of the new product determining process.

In the above description, the CPU 90 determines in S14 that the developer cartridge is a high-capacity developer cartridge if the detection count is not "2" in S15 (S15: NO), that is, if the detection count exceeds the detection numbers listed in the table 107. However, as indicated in S17 of FIG. 11, the CPU 90 may determine that an error has occurred in the new product determining process, rather than determining that the cartridge is a high-capacity developer cartridge, and may return to the main routine. After determining that an error has occurred in the new product determining process, the CPU 90 displays an error message on the control panel or the like.

Other than the variation described above, the flowchart in FIG. 11 has identical steps to the flowchart in FIG. 10.

In the preferred embodiment described above, the motor 59 is driven to rotate at full speed, which is the same rotational speed used in image formation, during an idle rotation operation, that is, during an operation to detect passage of the contact protrusions 82 with the optical sensor 92. However, the motor 59 may instead be driven at a slower speed during the idle rotation operation than during image formation. By driving the motor 59 at a slower speed, such as half speed, it is possible to improve the accuracy with which the CPU 90 determines the number of on/off detections of the optical sensor 92.

Figure 12:
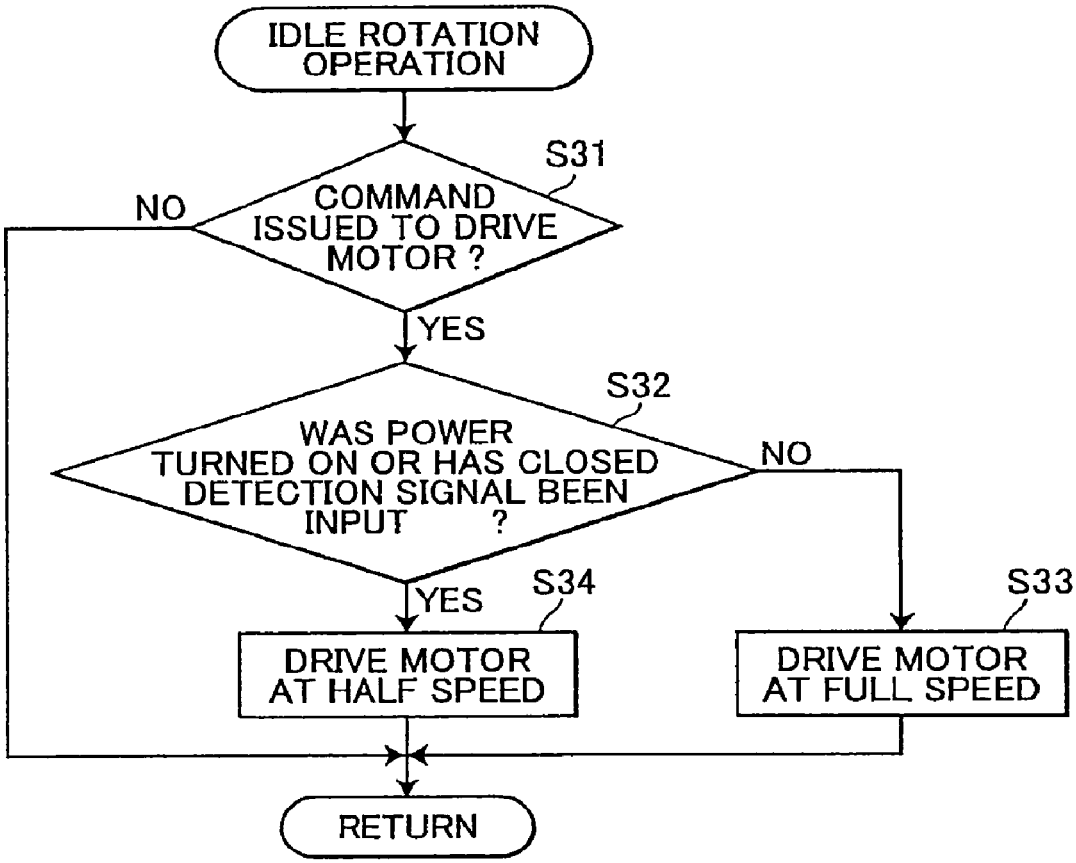
FIG. 12 is a flowchart illustrating steps in a motor rotational speed determining process.

FIG. 12 is a flowchart illustrating steps in a motor rotational speed determining process executed by the CPU 90 during the idle rotation operation. This process is performed as a step 2*a*, shown in FIG. 14. The motor rotational speed determining process is stored as the motor rotational speed determining program in the ROM 104 for driving the motor 59 at half speed during the idle rotation operation.

As shown in the motor rotational speed determining process of FIG. 12, the CPU 90 determines in S31 whether a command for driving the motor 59 to rotate has been issued for performing an image-forming operation, an idle rotation operation, or the like. If no command has been issued to drive the motor 59 (S31: NO), then the CPU 90 returns to the main routine, while the determination in S31 is repeatedly performed.

However, if a command has been issued to drive the motor 59 (S31: YES), then in S32 the CPU 90 determines whether the power has been turned on or whether a closed detection signal has been inputted into the CPU 90. If neither the power has been turned on nor a closed detection signal has been inputted into the CPU 90 (S32: NO), then the motor 59 is being driven to rotate for an image-forming operation. In this case, the CPU 90 drives the motor 59 at full speed in S33 and subsequently returns to the main routine.

However, if either the power has been turned on or a closed detection signal has been inputted into the CPU 90 (S32: YES), then the idle rotation operation described above has begun. In this case, the CPU 90 drives the motor 59 to rotate at half speed in S34 and subsequently returns to the main routine.

Figure 13:
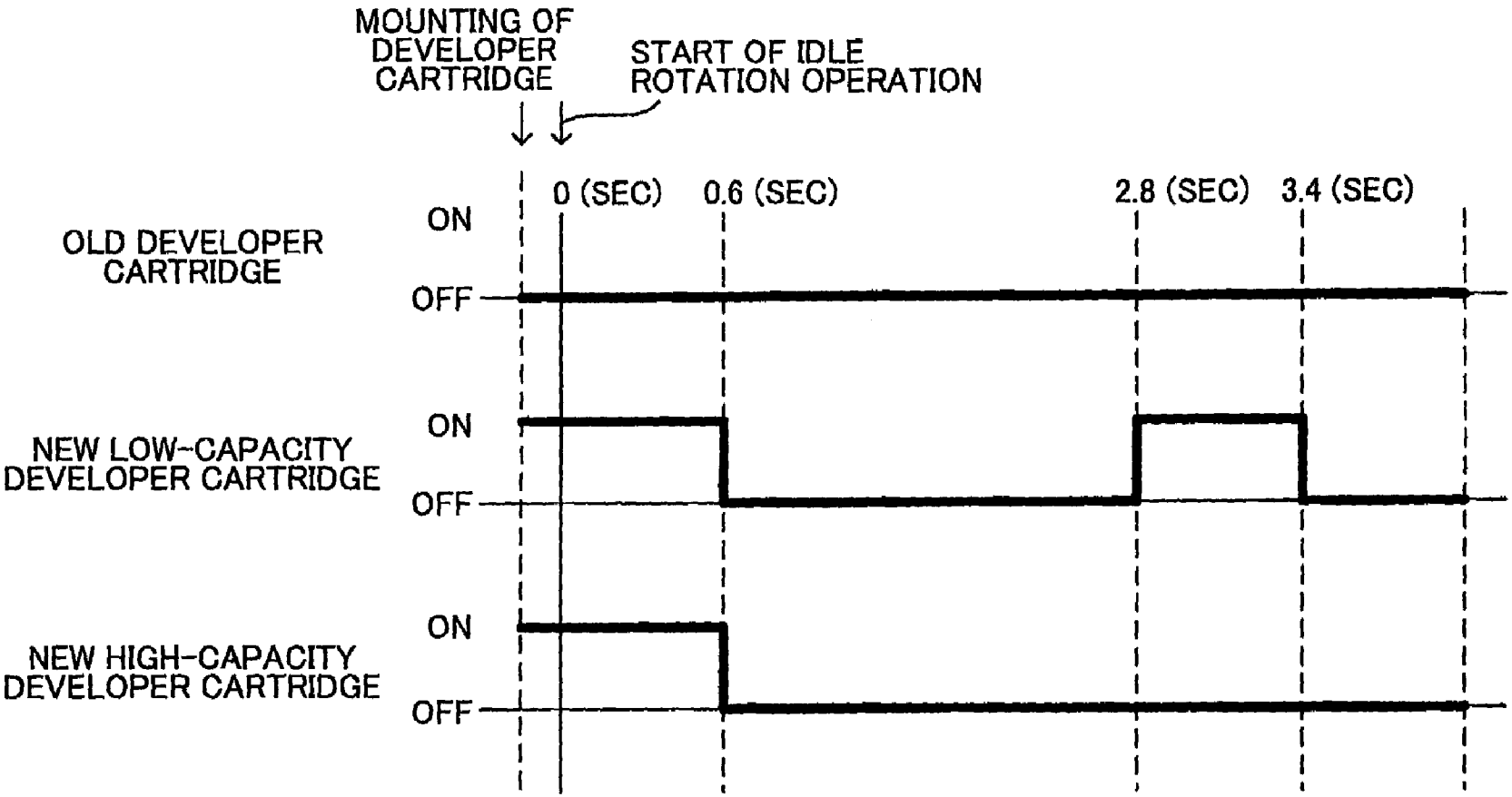
FIG. 13 is a timing chart for the new product determining process, when the motor is driven to rotate at half speed.
Figure 14:
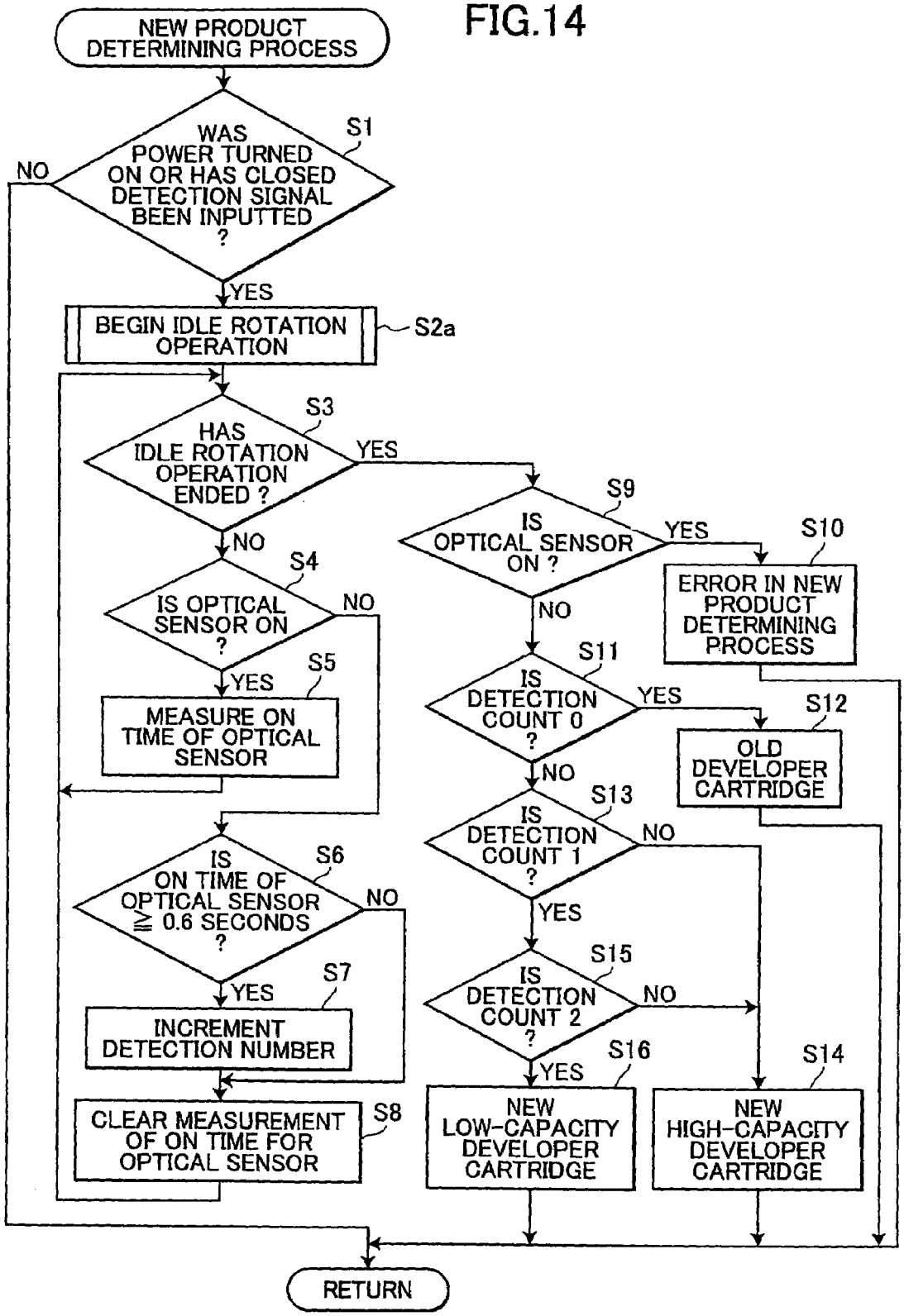
FIG. 14 is a flowchart illustrating steps in the new product determining process, when the motor is driven to rotate at half speed.

FIG. 13 is a timing chart for the new product determining process when the motor 59 is driven to rotate at half speed. FIG. 14 is a flowchart illustrating steps in the new product determining process when the motor 59 is driven to rotate at half speed.

As shown in FIG. 13, when a new high-capacity developer cartridge is mounted in the main casing 2, the optical sensor 92 turns on the moment the new cartridge is mounted, as described above. The CPU 90 then drives the motor 59 at half speed, after which the optical sensor 92 is turned off. When the motor 59 is driven at half speed, the time from the beginning of the idle rotation operation to the moment the optical sensor 92 turns off is 0.6 seconds.

When a new low-capacity developer cartridge is mounted in the main casing 2, the optical sensor 92 turns on the moment the new cartridge is mounted, as described above. The CPU 90 then drives the motor 59 at half speed, after which the optical sensor 92 is turned off. When the motor 59 is driven at half speed, the time from the beginning of the idle rotation operation to the moment the optical sensor 92 turns off is 0.6 seconds.

Subsequently, the optical sensor 92 is turned on again. When the motor 59 is driven at half speed, the time from when the optical sensor 92 turned off until the optical sensor 92 turns on again is 2.2 seconds (2.8 seconds from the start of the idle rotation operation to the moment the optical sensor 92 is turned on again).

Once again the optical sensor 92 is turned off. When the motor 59 is driven at half speed, the time from the moment the optical sensor 92 is turned on again until the optical sensor 92 is turned off again is 0.6 seconds (3.4 seconds from the start of the idle rotation operation until the optical sensor 92 is turned off again).

As described above, the optical sensor 92 is maintained in an off state when an old developer cartridge is mounted in the main casing 2.

Next, the new product determining process performed when driving the motor 59 at half speed will be described with reference to FIG. 14. Each step in the new product determining process in FIG. 14 is identical to those in the flowchart of FIG. 10, except step S6. In step S6 of FIG. 10 described above, the CPU 90 determines whether the time during which the optical sensor 92 is on exceeds 0.3 seconds, while in FIG. 14 the CPU 90 determines whether the time has exceeded 0.6 seconds.

Specifically, since the optical sensor 92 remains on longer when the motor 59 is driven at half speed, the CPU 90 determines whether the ON time of the optical sensor 92 has exceeded 0.6 seconds in the new product determining process of FIG. 14. If this ON time has exceeded 0.6 seconds (S6: YES), then the CPU 90 determines that a reception signal has been inputted and increments in the detection number in S7. In S8 the CPU 90 clears the measured ON time of the optical sensor 92 stored in the NVRAM 106. However, if the ON time of the optical sensor 92 is less than 0.6 seconds (S6: NO), then the CPU 90 determines that the signal was caused by noise. Hence, the CPU 90 does not increment the detection number in S7, but in S8 clears the measured time stored in the NVRAM 106.

By driving the motor 59 at half speed in the idle rotation operation, the optical sensor 92 can detect the passage of the contact protrusion 82 with greater accuracy. Therefore, the CPU 90 can determine when reception signals are inputted from the optical sensor 92 with greater accuracy. As a result, the CPU 90 can reliably determine when the mounted cartridge is a high-capacity developer cartridge or a low-capacity developer cartridge.

In the preferred embodiment described above, the developer cartridge 30 is provided separately from the process frame 27, and the photosensitive drum 28 is provided in the process frame 27. However, it is obvious that the developer cartridge according to the present invention may be formed integrally with the process frame 27.

Although the present invention has been described with respect to specific embodiments, it will be appreciated by one skilled in the art that a variety of changes may be made without departing from the scope of the invention.

For example, the present invention is applicable to not only a monochromatic image-forming device in which a single developer cartridge is mountable but also a full-color image-forming device in which four cartridges separately accommodating yellow, magenta, cyan, and black toner are mountable.

What is claimed is:

1. An image-forming device comprising:

a body;

a developer cartridge accommodating developer therein and detachable from the body;

a motor generating a driving force;

a driving member disposed in the developer cartridge and capable of being driven by the motor a prescribed distance from a starting position to an ending position when the developer cartridge is mounted in the body;

a moving member provided in association with the driving member so as to be movable together with the driving member;

an information detecting section that detects the moving member as the moving member moves together with the driving member and outputs detection results; and a controller that acquires at least two pieces of information on the developer cartridge based on the detection results output from the information detecting section.

2. The image-forming device according to claim 1, wherein the information detecting section comprises a contact member contactable with the moving member, wherein the moving member moves while pushing the contact member.

3. The image-forming device according to claim 2, wherein the contact member contacts the moving member when the developer cartridge is mounted in the body.

4. The image-forming device according to claim 1, wherein the driving member comprises a partly toothed gear having a toothed part for transferring the driving force from the motor, and a toothless part for not transferring the driving force from the motor.

5. The image-forming device according to claim 4, wherein the developer cartridge comprises a transfer gear that transfers the driving force from the motor when the developer cartridge is mounted in the body, and the partly toothed gear is meshingly engaged with the transfer gear.

6. The image-forming device according to claim 5, wherein the developer cartridge further comprises an urging member that urges the partly toothed gear toward the transfer gear in order to engage therewith.

7. The image-forming device according to claim 1, wherein a plurality of moving members are provided in association with the driving member.

8. The image-forming device according to claim 1, wherein one or more moving members is provided in association with the driving member, the number of the moving members being indicative of information on the developer cartridge, and the controller decodes the information on the developer cartridge based on the number of the moving members detected by the information detecting section.

9. The image-forming device according to claim 1, wherein a width of the moving member along the moving direction thereof corresponds to information on the developer cartridge, and the controller decodes the information on the developer cartridge based on a detection time during which the information detecting section detects the moving member.

10. The image-forming device according to claim 1, wherein the information on the developer cartridge is information indicating whether the developer cartridge is a new product.

11. The image-forming device according to claim 1, wherein the information on the developer cartridge is information on a maximum number of a recording medium on which images can be formed with the developer accommodated in the developer cartridge.

12. The image-forming device according to claim 1, wherein a first piece of information of the at least two pieces of information indicates a number of sheets that can be printed using the developer cartridge.

13. The image-forming device according to claim 12, wherein a second piece of information of the at least two pieces of information indicates whether the developer cartridge is old or new.

14. An image-forming device comprising:

a body;

a developer cartridge accommodating developer therein and detachable from the body;

a motor generating a driving force;

a driving member disposed in the developer cartridge and capable of being driven by the motor a prescribed distance from a starting position to an ending position when the developer cartridge is mounted in the body;

a moving member provided in association with the driving member so as to be movable together with the driving member;

an information detecting section that detects the moving member as the moving member moves together with the driving member and outputs detection results; and a controller that acquires at least two pieces of information on the developer cartridge based on the detection results output from the information detecting section, wherein a first number of moving members are provided when an amount of developer accommodated in the developer cartridge is a first amount, and a second number larger than the first number of moving members are provided when an amount of developer accommodated in the developer cartridge is a second amount smaller than the first amount; and the controller determines that the amount of developer accommodated in the developer cartridge is the first amount when a detection number of the moving members detected by the information detecting section corresponds to the first number and determines that the amount of developer accommodated in the developer cartridge is the second amount when a detection number of the moving members corresponds to the second number.

15. The image-forming device according to claim 14, further comprising a memory that stores a table that associates the first amount and the second amount with the detection number corresponding to the first number and the detection number corresponding to the second number, respectively, wherein the controller references the memory and determines that the amount of developer accommodated in the developer cartridge is the first amount when the detection number is outside the detection numbers listed in the table.

16. The image-forming device according to claim 14, wherein the motor reduces a speed for moving the moving member from a speed used in image formation during an operation for detecting the moving member with the information detecting section.

17. The image-forming device according to claim 14, wherein a first piece of information of the at least two pieces of information indicates a number of sheets that can be printed using the developer cartridge.

18. The image-forming device according to claim 17, wherein a second piece of information of the at least two pieces of information indicates whether the developer cartridge is old or new.

19. A developer cartridge that is detachably mountable in an image-forming device, the developer cartridge comprising:

a driving member capable of being driven from an original position to an ending position when the developer cartridge is mounted in the image-forming device; and a plurality of protrusions provided in association with the driving member so as to be movable together with the driving member, wherein while the driving member is driven from the original position to the ending position when the developer cartridge is mounted in the image forming device, the plurality of protrusions pass through a position where the plurality of protrusions are detected by the image forming device.

20. The developer cartridge according to claim 19, wherein the driving member comprises a partly toothed gear having a toothed part for receiving a driving force from a motor in the image forming device, and a toothless part for not receiving the driving force from the motor.

21. A developer cartridge that is detachably mountable in an image-forming device, the developer cartridge comprising:

a partly toothed gear capable of being driven from an original position to an ending position when the developer cartridge is mounted in the image-forming device, the partly toothed gear being formed with a toothed part for receiving a driving force from a motor, and a toothless part for not receiving the driving force from the motor; and a plurality of protrusions movable together with the partly toothed gear, the plurality of protrusions being disposed within a fanned-shape including an arcuate portion having the toothed part.

22. The developer cartridge according to claim 21, further comprising a transfer gear engaged with the partly toothed gear.

23. The developer cartridge according to claim 21, further comprising an urging member that urges the partly toothed gear toward the transfer gear.

24. The developer cartridge according to claim 23, wherein an end of the toothed part engages the transfer gear when the urging member urges the partly toothed gear toward the transfer gear.

25. The developer cartridge according to claim 21, wherein the plurality of protrusions have end portions arranged on a predetermined circle.

26. A developer cartridge comprising:

a casing;

a developer roller having a developer roller shaft rotatably supported in the casing;

a developer roller gear fixed to the developer roller shaft, the developer roller gear being rotatable with the developer roller shaft;

an associated gear rotatably provided in the casing, the associated gear being rotatable about an axis in accordance with rotation of the developer roller gear; and a plurality of protrusions formed on the associated gear, wherein each of the plurality of the protrusions extends from a part, which is different from where the axis is, of a surface of the associated gear in a direction parallel to the axis.

27. The developer cartridge according to claim 26, wherein the surface of the associated gear faces outwardly.

28. The developer cartridge according to claim 26, wherein the associated gear comprises a partly toothed gear having a circumferential part formed with a toothed part where gear teeth are formed and a toothless part where gear teeth are not formed.

29. A developer cartridge comprising:

a casing having confronting side walls, the casing accommodating a developer;

a developer roller having a developer roller shaft rotatably supported between the confronting side walls;

a developer roller gear fixed to the developer roller shaft, the developer roller gear being rotatable with the developer roller shaft;

a supply roller that is configured to supply the developer roller with the developer, the supply roller having a supply roller shaft rotatably supported between the confronting side walls;

a supply roller gear fixed to the supply roller shaft, the supply roller gear being rotatable with the supply roller shaft;

an agitator that is configured to stir the developer in the casing, the agitator having an agitator shaft rotatably supported between the confronting side walls;

an agitator gear fixed to the agitator shaft, the agitator gear being rotatable with the agitator shaft;

a gear mechanism including an input gear, the gear mechanism transferring a driving force from the input gear to each of the developer roller gear, the supply roller gear, and the agitator drive gear; and an associated gear rotatably provided in one of the confronting side walls;

wherein the associated gear includes:

a circumferential part in which a toothed part is formed; and a plurality of protrusions extending from the associated gear, wherein the rotation of the agitator gear is configured to be transferred to the associated gear.

30. The developer cartridge according to claim 29, wherein the gear mechanism, the agitator gear and the associated gear define a transmitting communication to transmit the driving force from the input gear to the associated gear via the agitator gear, the associated gear being disposed in a downstream end of the transmitting communication.

31. The developer cartridge according to claim 29, wherein the associated gear is engaged only with the agitator gear.

32. The developer cartridge according to claim 31, wherein an end of the toothed part engages the agitator gear when an urging member urges the associated gear toward the agitator gear.

33. The developer cartridge according to claim 31, wherein the associated gear comprises a partly toothed gear formed with a toothed part and a toothless part in the circumferential part, the partly toothed gear being driven a prescribed amount from an original position to an ending position, the toothless part opposing the agitator gear at the ending position so that the partly toothed gear is disengaged from the agitator gear at the ending position.

34. The developer cartridge according to claim 29, wherein the associated gear rotates in a direction opposite of a direction in which the input gear rotates.

35. The developer cartridge according to claim 34, wherein the associated gear rotates in a direction same as a direction in which the developer roller gear rotates.

36. The developer cartridge according to claim 35, wherein the associated gear rotates in a direction same as a direction in which the supply roller gear rotates.

37. The developer cartridge according to claim 29, wherein each of the plurality of the protrusions extend from a part, which is different from where an axis is provided, of a surface of the associated gear in a direction parallel to the axis, the surface of the associated gear facing outwardly.

38. The developer cartridge according to claim 29, wherein the supply roller gear is directly engaged with the input gear.

39. The developer cartridge according to claim 29, wherein the developer roller gear is directly engaged with the input gear.

* * * * *